US006094921A

United States Patent [19]

Zhu et al.

[11] Patent Number: 6,094,921

[45] Date of Patent: Aug. 1, 2000

[54] PULSE TUBE REFRIGERATOR

[75] Inventors: Shaowei Zhu; Shin Kawano, both of Kariya; Tatsuo Inoue, Anjo; Masafumi Nogawa, Toyota, all of Japan

[73] Assignee: Aisin Seiki Kabushiki Kaisha, Kariya, Japan

[21] Appl. No.: 09/135,797

[22] Filed: Aug. 18, 1998

[30] Foreign Application Priority Data

Aug. 18, 1997 [JP] Japan ..... 9-221760

[51] Int. Cl.[7] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 4,498,296 | 2/1985 | Dijkstra | 62/6 |
| 5,269,147 | 12/1993 | Ishizaki et al. | 62/6 |
| 5,275,002 | 1/1994 | Inoue et al. | 62/6 |
| 5,295,355 | 3/1994 | Zhou et al. | 62/6 |
| 5,515,685 | 5/1996 | Yanai et al. | 62/6 |
| 5,522,223 | 6/1996 | Yanai et al. | 62/6 |

OTHER PUBLICATIONS

David et al, "How To Achieve The Efficiency of a Gifford–Mac Mahon Cryocooler With a Pulse Tube Refrigerator", Cryogenics 190 vol. 30 Sep. Supplement, pp. 262–266.

Mikulin et al, "Low–Temperature Expansion Pulse Tubes", Advances In Cryogenic Engineering, vol. 29, pp. 629–637.

P. 35 of 55$^{th}$ Symposium of Association of Low Temperature Engineering/Superconduction (discussed in the specification).

*Primary Examiner*—Ronald Capossela

*Attorney, Agent, or Firm*—Oblon, Spivak, McClelland, Maier & Neustadt, P.C.

[57] ABSTRACT

A pulse tube refrigerator includes a regenerator including a cold end and a hot end, a cold head connected to the cold end of the regenerator, a pulse tube having a cold end and a hot end and connected at its cold end to the cold head, a pressure fluctuation source connected to the hot end of the regenerator, a buffer connected to the hot end of the pulse tube through an orifice, and an auxiliary buffer connected to the hot end of the pulse tube through a buffer side control valve. The buffer and the auxiliary buffer may be replaced by a single buffer connected to the hot end of the pulse tube through an orifice and a buffer side control valve which are arranged in parallel.

12 Claims, 14 Drawing Sheets

PULSE TUBE REFRIGERATOR

BACKGROUND OF THE INVENTION

1. Field of the Invention

The present invention relates to a pulse tube refrigerator and, more particularly, to a structure of a pulse tube refrigerator having an improved refrigerating efficiency.

2. Related Art

A conventional pulse tube refrigerator is disclosed on pp. 35 of Summary of 55th Symposium of Association of Low Temperature Engineering/Superconduction, as held in autumn, 1996. This pulse tube refrigerator will be described with reference to FIGS. 20 to 22.

In FIG. 20, a pulse tube refrigerator 111 includes a regenerator 1 having a cold end 1*a* and a hot end 1*b*; a cold head 2 connecting to the cold end 1*a* of the regenerator 1; a pulse tube 3 having a cold end 3*a* and a hot end 3*b* and connected at its cold end 3*a* to the cold head 2; a pressure fluctuation source connected to the hot end 1*b* of the regenerator 1; and a buffer 5 connected to the hot end 3*b* of the pulse tube 3 through an orifice 4. The pressure fluctuation source includes a compressor 10; a high-pressure control valve 11 connected to the outlet port of the compressor 10 through a high-pressure passage 18; a low-pressure control valve 12 connected to the inlet port of the compressor 10 through a low-pressure passage 19; and a connection passage connecting the high-pressure control valve 11 and the low-pressure control valve 12 to the hot end 1*b* of the regenerator 1.

The operation of the pulse tube refrigerator thus constructed will be described with reference to FIGS. 21 and 22. Here, FIG. 21 is a graph illustrating both the controlled states (of which the opened states are indicated by thick lines and the closed states are indicated by thin lines) of the high-pressure control valve 11 and the low-pressure control valve 12 over time, and the pressure states of the working fluid in the buffer 5 and the pulse tube 3 over time. FIG. 22 is an equivalent PV diagram illustrating the relation between the displacement and the pressure of the working fluid in the vicinity of the cold end 3*a* of the pulse tube 3.

As seen from FIG. 21, the operation states of the pulse tube refrigerator and the corresponding states of the internal working fluid may be divided in terms of the time into the following six Steps a to f:

(1) Step a (First Half Step of Compression)

The state in which the high-pressure and low-pressure control valves 11 and 12 are kept closed by closing the low-pressure control valve 12. In this state, the working fluid in the buffer 5 flows into the pulse tube 3 through the orifice 4 so that the pressure in the pulse tube 3 rises to the buffer pressure.

(2) Step b (Second Half Step of Compression)

The state in which the high-pressure control valve 11 is opened when the pressure in the pulse tube 3 rises from the minimum pressure to the buffer pressure. In this state, the high-pressure passage 18 and the pulse tube 3 come into communication so that the pressure in the pulse tube 3 rises from the buffer pressure to the maximum pressure.

(3) Step c (Transfer Step to High Pressure)

The Step in which the high-pressure control valve 11 is kept open. In this state, the working fluid in the pulse tube 3 continuously flows out to the buffer 5 through the orifice 4, and the working fluid from the compressor 10 flows into the regenerator 1 via the high-pressure control valve 11, and into the pulse tube 3 while being cooled in the regenerator 1.

(4) Step d (First Half Step of Expansion)

The state in which the high-pressure and low-pressure control valves 11 and 12 are kept closed by closing the high-pressure control valve 11. In this state, the working fluid in the pulse tube 3 flows into the buffer 5 through the orifice 4 so that the pressure in the pulse tube 3 drops from the maximum pressure to the buffer pressure. As a result of this pressure drop, the working fluid in the pulse tube 3 adiabatically expands to lower its temperature.

(5) Step e (Second Half Step of Expansion)

The Step in which the low-pressure control valve 12 is opened when the pressure in the pulse tube 3 falls from the maximum pressure to the buffer pressure. In this state, the low-pressure passage 19 and the pulse tube 3 come into communication so that the pressure in the pulse tube 3 drops from the buffer pressure to the minimum pressure. As a result, the working fluid in the pulse tube 3 further adiabatically expands to lower its temperature.

(6) Step f (Low-pressure Transfer Step)

The state in which the low-pressure control valve 12 is kept open. In this state, the working fluid in the buffer 5 continuously flows into the pulse tube 3 through the orifice 4, and the cold working fluid in the pulse tube 3 cools the cold head 2 and the regenerator 1 and flows out from the low-pressure control valve 12 to the compressor 10.

The foregoing Steps a to f comprise one cycle and are repeated to establish an extremely low temperature in the cold head 2.

The conventional system thus far described is characterized by providing Step a and Step d in the running cycle of the pulse tube refrigerator. The equivalent PV diagram of the case, in which Steps a and d are omitted and in which the high-pressure and low-pressure control valves 11 and 12 are alternately opened without any standby time, is illustrated by dotted lines in FIG. 22. On the other hand, the equivalent PV diagram of the case having Steps a and d is illustrated by solid lines in FIG. 22. It is apparent from the comparison between the equivalent PV diagrams of the two cases that the case with Steps a and d has a larger area for the section enclosed by the PV diagram. This area determines the upper limit of the refrigerating output of the regenerator, so that the refrigerating capacity can be enhanced without increasing a heat loss, due to the displacement by enlarging the area while retaining the magnitude of the displacement of the working fluid.

FIG. 23 is a schematic diagram showing another conventional pulse tube refrigerator. This pulse tube refrigerator 112 is constructed by connecting the hot end 3*b* of the pulse tube 3 and the buffer 7 via a buffer side control valve 6, but the remaining construction is identical to that of the pulse tube refrigerator 111 shown in FIG. 19. FIG. 24 is a graph illustrating both the controlled states (of which the opened states are indicated by thick lines and the closed states are indicated by thin lines) of the high-pressure control valve 11, the low-pressure control valve 12 and the buffer side control valve 6 over time when the pulse tube refrigerator of FIG. 23 is operating, and the pressure states of the working fluid in the buffer 7 and the pulse tube 3 over time. With reference to FIG. 24, the operation characteristics of this pulse tube refrigerator 112 will be described, stressing the control actions of the buffer side control valve 6.

(1) At Step a (First Half Step of Compression), the buffer side control valve 6 is opened to connect the pulse tube 3 and the buffer 7 so as to raise the pressure in the pulse tube 3 from the minimum pressure to the buffer pressure.

(2) At Step b (Second Half Step of Compression), the pressure in the pulse tube 3 has already risen to the buffer pressure and is raised to the maximum by closing the buffer side control valve 6 and by opening the high-pressure control valve 11.

(3) At Step c (Transfer Step to High Pressure), the buffer side control valve 6 is opened to transfer working fluid in the pulse tube 3 under a high pressure to the buffer 7. At this time, the working fluid flows from the compressor 10 into the regenerator 1 via the high-pressure control valve 11, and into the pulse tube 3 while being cooled by the regenerator 1.

(4) At Step d (First Half Step of Expansion), the high-pressure control valve 11 is closed to lower the pressure in the pulse tube 3 to the buffer pressure. As a result of this pressure drop, the working fluid in the pulse tube 3 adiabatically expands to lower its temperature.

(5) At Step e (Second Half Step of Expansion), the pressure in the pulse tube 3 has already dropped to the buffer pressure and is lowered to the minimum pressure by closing the buffer side control valve 6 and by opening the low-pressure control valve 12. As a result, the working fluid in the pulse tube 3 further adiabatically expands to lower its temperature.

(6) At Step f (Low-pressure Transfer Step), the buffer side control valve 6 is opened to transfer the working fluid in the buffer 7 to the pulse tube 3. At this time, the working fluid in the pulse tube 3 cools the cold head 2 and the regenerator 1 and further flows out from the low-pressure control valve 12 to the compressor 10.

The foregoing Steps a to f comprise one cycle and are repeated to establish an extremely low temperature in the cold head 2. The equivalent PV diagram of the working fluid in the run of the pulse tube refrigerator 112 thus far described is identical to that indicated by the solid lines in FIG. 22.

For an efficient operation of the pulse tube refrigerator, it is necessary to provide a sufficient time period to the high-pressure transfer Step (i.e., Step c) and the low-pressure transfer Step (i.e., Step f) of the working fluid. This is because the flow rate of the working fluid through the regenerator at the high-pressure transfer Step and the low-pressure transfer Step is higher than that at the remaining Steps, so that a longer time period has to be taken for reducing the heat loss at the regenerator.

In view of the conditions for making such pulse tube refrigerator efficient, here will be examined the running operations of the pulse tube refrigerator 111. In this pulse tube refrigerator, at Steps a and b, the communication between the working fluid in the pulse tube and the working fluid in the buffer is via the orifice 4 so that a relatively long time period is required for raising or lowering the pressure in the pulse tube to the buffer pressure. If the operation of the pulse tube refrigerator is to be realized within a limited cycle time period, therefore, the time period is mostly taken for Steps a and d so that Steps c and f have to be finished within a relatively short time period. This raises a problem that the heat loss in the regenerator is increased to make it impossible to run the pulse tube refrigerator efficiently. In the pulse tube refrigerator 112, on the other hand, the communication between the working fluid in the pulse tube and the working fluid in the buffer is made through the buffer side control valve 6. At Steps a and d, therefore, the pressure in the pulse tube is quickly raised or lowered to the buffer pressure, and the time periods for Steps c and f also have to be shortened. This is because the communication between the working fluid in the pulse tube and the working fluid in the buffer is made through the control valve so that the longer time period for Steps c and f make the displacement of the working fluid so large as to increase the heat loss due to the displacement. In short, the pulse tube refrigerator 112 must equalize the time periods for Steps a and d and Steps c and f. When a buffer side control valve having a small opening is used to extend the time period for Steps c and f, on the contrary, the time period for Steps a and d is made as long as that of the pulse tube refrigerator 111. Thus, the efficiency of the conventional pulse tube refrigerators is limited no matter what construction and running operation might be taken.

SUMMARY OF THE INVENTION

In view of the background thus far described, therefore, an object of the invention is to provide a pulse tube refrigerator for more efficient operation.

In order to solve the above-specified and other objects, according to a first aspect of the invention there is provided a pulse tube refrigerator comprising a regenerator including a cold end and a hot end; a cold head connected to the cold end of the regenerator; a pulse tube having a cold end and a hot end and connected at its cold end to the cold head; a pressure fluctuation source connected to the hot end of the regenerator; a buffer connected to the hot end of the pulse tube through an orifice; and an auxiliary buffer connected to the hot end of the pulse tube through a buffer side control valve.

To the hot end of the pulse tube, according to the first aspect, there are individually connected the buffer having the orifice and the auxiliary buffer having the control valve. At Steps a and b, making use of the buffer for fluctuating the pressure in the pulse tube, therefore, the buffer side control valve can be opened. At Steps c and f, making use of the buffer for transferring the working fluid in the pulse tube, moreover, the buffer side control valve can be opened. Thus, the buffer side control valve is opened at Steps a and b so that the pressure in the pulse tube quickly rises or falls to the auxiliary buffer pressure, and the buffer side control valve is closed at Steps c and f so that the displacement of the working fluid is not excessively enlarged even if a long time period is taken for Steps c and f. As a result, the time period for Steps a and d can be shortened whereas the time period for Steps c and f can be increased to provide a pulse tube regenerator having improved efficiency.

According to a second aspect of the invention, there is provided a pulse tube refrigerator comprising a regenerator including a cold end and a hot end; a cold head connected to the cold end of the regenerator; a pulse tube having a cold end and a hot end and connected at its cold end to the cold head; a pressure fluctuation source connected to the hot end of the regenerator; and a buffer connected to the hot end of the pulse tube through an orifice and a buffer side control valve arranged in parallel.

To the hot end of the pulse tube according to the second aspect, there is connected the buffer having the orifice and the buffer side control valve which are arranged in parallel. At Steps a and b, making use of the buffer for fluctuating the pressure in the pulse tube, therefore, the buffer side control valve can be opened. At Steps c and f, making use of the buffer for transferring the working fluid in the pulse tube, moreover, the buffer side control valve can be opened. Thus, the buffer side control valve is opened at Steps a and b so that the pressure in the pulse tube quickly rises or falls to the auxiliary buffer pressure, and the buffer side control valve is closed at Steps c and f so that the displacement of the working fluid is not excessively enlarged even if a long time period is taken for Steps c and f. As a result, the time period for Steps a and d can be shortened whereas the time period for Steps c and f can be elongated to provide a pulse tube regenerator having improved efficiency.

Moreover, the pressure fluctuation source may preferably include a compressor; a high-pressure control valve connected to the outlet port of the compressor via a high-pressure passage; a low-pressure control valve connected to the inlet port of the compressor via a low-pressure passage; and a connection passage connecting the high-pressure control valve and the low-pressure control valve to the hot end of the regenerator.

Moreover preferably, the pulse tube refrigerator further comprises a high-pressure second passage connecting the high-pressure passage to the hot end of the pulse tube through a high-pressure second control valve; and a low-pressure second passage connecting the low-pressure passage to the hot end of the pulse tube through a low-pressure second control valve.

According to this construction, there is provided the high-pressure second passage which connects the high-pressure passage to the hot end of the pulse tube through the high-pressure second control valve. By opening the high-pressure second control valve at Step b (or Second Half Step of Compression), therefore, the communication between the high-pressure passage and the pulse tube is provided by way of two passages: the passage from the high-pressure passage to the pulse tube cold end through the high-pressure control valve, the regenerator and the cold head; and the passage from the high-pressure passage to the pulse tube hot end via the high-pressure second passage having the high-pressure second control valve. In this course, the pulse tube is exposed to the pressure from both the cold end and the hot end. Thus, the pulse tube is exposed to the high pressure from two sides thereby to suppress displacement and fluctuation of the working fluid in pulse tube during the pressure rise at Step b.

Likewise, there is provided the low-pressure second passage which connects the low-pressure passage to the hot end of the pulse tube through the low-pressure second control valve. By opening the low-pressure second control valve at Step e (or Second Half Step of Expansion), therefore, the communication between the low-pressure passage and the pulse tube is provided by way of two passages: the passage from the low-pressure passage to the pulse tube hot end through the low-pressure control valve, the regenerator and the cold head; and the passage from the low-pressure passage to the pulse tube hot end via the low-pressure second passage having the low-pressure second control valve. The pulse tube is released from the pressure from the cold end and the hot end, thereby to suppress the displacement and fluctuation of the working fluid in the pulse tube during the pressure drop at Step e. As a result, the area of the region enclosed by the equivalent PV diagram can be enlarged to better improve the efficiency of the pulse tube refrigerator.

The pulse tube refrigerator may further comprise a high-pressure second connection passage connecting the connection passage to the hot end of the pulse tube through a high-pressure second control valve; and a low-pressure second connection passage connecting the connection passage to the hot end of the pulse tube through a low-pressure second control valve. This construction can provide actions and effects similar to the aforementioned ones.

The pulse tube refrigerator may yet further comprise a common passage connecting the connection passage to the hot end of the pulse tube through a common control valve. In addition to actions and effects similar to those aforementioned, according to this construction the connection passage is connected to the hot end of the pulse tube through the single common control valve so that the control structures of the individual valves can be simplified.

The pulse tube refrigerator may yet further comprise a double inlet passage connecting the connection passage to the hot end of the pulse tube through an orifice. In addition to actions and effects similar to the aforementioned ones, according to this construction the connection passage and the pulse tube hot end are connected through the orifice so that this orifice need not be controlled to further simplify the control structure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The invention will be described in connection with its embodiments with reference to the accompanying drawings.

[First Embodiment]

Figure 1:
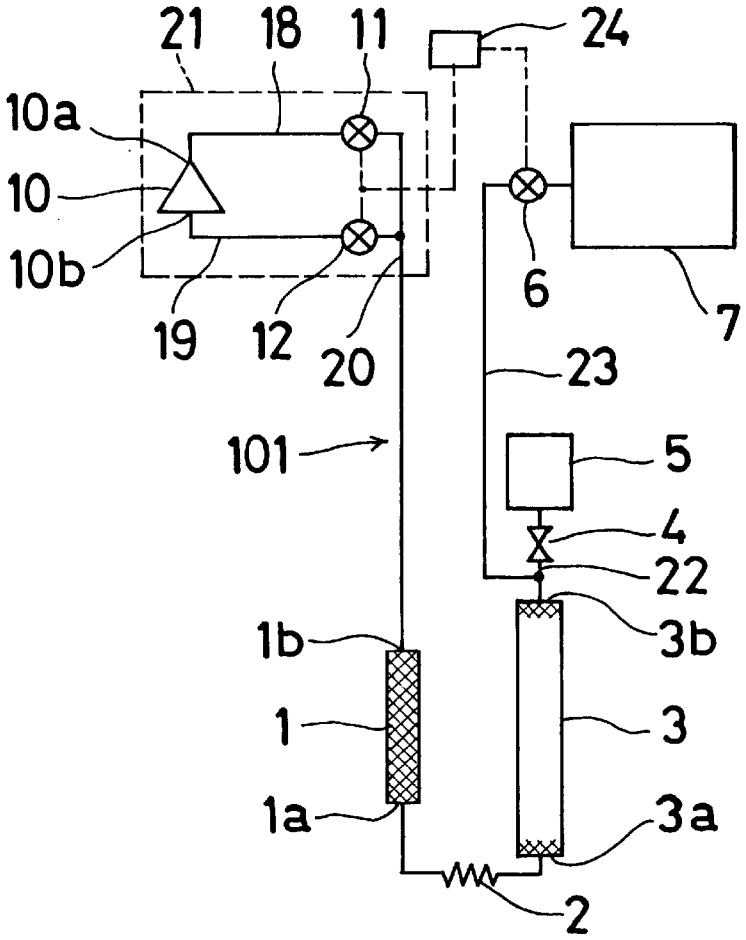
FIG. 1 is a schematic diagram showing the construction of a pulse tube refrigerator according to a first embodiment of the invention.

The first embodiment will be described with reference to FIGS. 1 to 3. FIG. 1 is a schematic diagram showing a pulse tube refrigerator according to this embodiment. In FIG. 1, a pulse tube refrigerator 101 includes: a regenerator 1 having a cold end 1*a* and a hot end 1*b*; a cold head 2 connecting to the cold end 1*a* of the regenerator 1; a pulse tube 3 having a cold end 3*a* and a hot end 3*b* and connected at its cold end 3*a* to the cold head 2; a pressure fluctuation source 21 connected to the hot end 1*b* of the regenerator 1; and a buffer 5 connected to the hot end 3*b* of the pulse tube 3 through an orifice 4.

To the mid-portion of a passage 22 connecting the hot end 3*b* of the pulse tube 3 and the orifice 4, on the other hand, there is connected one end of a branch passage 23, the other end of which is connected to an auxiliary buffer 7 through a buffer side control valve 6. In other words, there are arranged in one pulse tube refrigerator two buffers, one of which is connected to the pulse tube hot end through the orifice and the other of which is connected to the pulse tube hot end through the control valve.

The pressure fluctuation source 21 includes: a compressor 10; a high-pressure control valve 11 connected to the outlet port 10*a* of the compressor 10 through a high-pressure passage 18; a low-pressure control valve 12 connected to the inlet port. 10*b* of the compressor 10 through a low-pressure passage 19; and a connection passage 20 connecting the high-pressure control valve 11 and the low-pressure control valve 12 to the hot end 1*b* of the regenerator 1.

The high-pressure control valve 11, the low-pressure control valve 12 and the buffer side control valve 6 are individually controlled to open/close by a control unit 24. The control unit 24 may be exemplified by various modes such as a 3-input 2-output rotary valve unit having a high-pressure inlet (connected to the high-pressure passage 18), a low-pressure inlet (connected to the low-pressure passage 19), a buffer pressure inlet (connected to the branch passage 23 between the buffer side control valve 6 and the auxiliary buffer 7), a regenerator side outlet (connected to the regenerator hot end 1*b*) and a pulse tube side outlet (connected to the pulse tube hot end 3*b*). In this rotary valve unit, the high-pressure control valve 11, the low-pressure control valve 12 and the buffer side control valve 6 may be mechanically controlled to open/close by constructing them with the control unit 24. Alternatively, the high-pressure control valve 11, the low pressure control valve 12 and the buffer side control valve 6 may be solenoid valves which are electrically controlled to open/close by the control unit 24. Here, in the case of the rotary valve unit, the control timings of the individual valves can be easily adjusted by making a 2-rotor type having a high-low pressure switching rotor and a buffer pressure control rotor.

Figure 2:
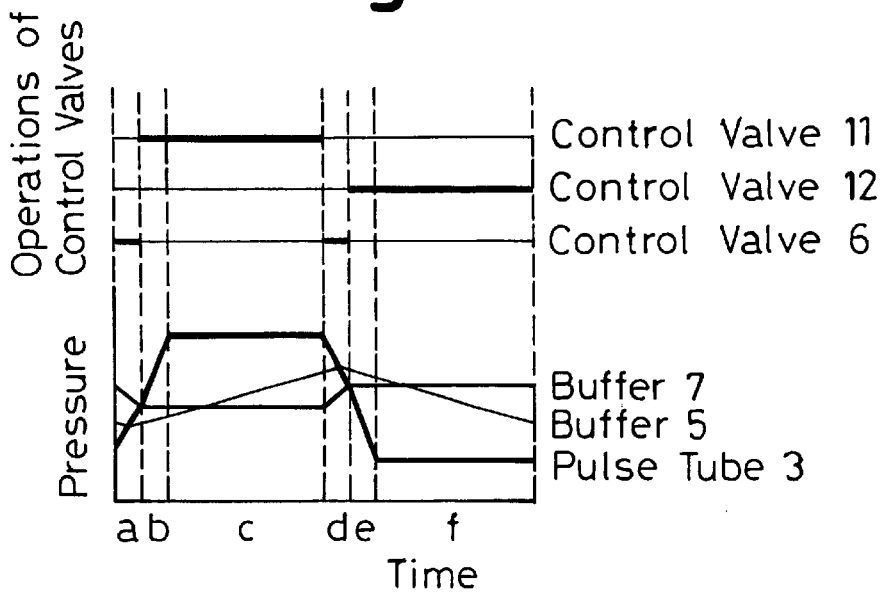
FIG. 2 is a graph illustrating the action states and pressure states of control valves of the pulse tube refrigerator in the first embodiment of the invention.

FIG. 2 is a graph illustrating both the controlled states (of which the opened states are indicated by thick lines and the closed states are indicated by thin lines) of the high-pressure control valve 11, the low-pressure control valve 12 and the buffer side control valve 6 over time when the pulse tube refrigerator 101 of FIG. 1 is operating, and the pressure states of the working fluid in the buffer 5 and the pulse tube 3 over time. FIG. 3 is an equivalent PV diagram illustrating the relation between the displacement and the pressure of the working fluid in the vicinity of the cold end 3*a* of the pulse tube 3.

The operation of the pulse tube refrigerator thus constructed will be described with reference to the accompanying drawings. As in the description of the conventional refrigerators, the operation states of the pulse tube refrigerator 101 and the states of the internal working fluid accompanying the operations are divided in terms of time into the following six Steps a to f.

(1) Step a (First Half Step of Compression)

The state in which the high-pressure and low-pressure control valves 11 and 12 are kept closed whereas the buffer side control valve 6 is kept open by closing the low-pressure control valve 12 and by opening the buffer side control valve 6. In this state, the working fluid in the buffer 5 flows into the pulse tube 3 through the orifice 4, and the working fluid in the auxiliary buffer 7 also flows into the pulse tube 3 through the buffer side control valve 6. In this case, the auxiliary buffer 7 and the pulse tube 3 are in communication with each other through the buffer side control valve 6 having a low pressure loss so that the pressure in the pulse tube 3 quickly rises from the minimum pressure to the pressure of the auxiliary buffer 7.

(2) Step b (Second Half Step of Compression)

The state in which the high-pressure control valve 11 is opened whereas the buffer side control valve 6 is closed when the pressure in the pulse tube 3 rises from the minimum pressure to the auxiliary buffer pressure. In this state, the high-pressure passage 18 and the pulse tube 3 come into communication, but the communication between the pulse tube 3 and the auxiliary buffer 7 is interrupted by closing the buffer side control valve 6, so that the pressure in the pulse tube 3 rises from the auxiliary buffer pressure to the maximum pressure.

(3) Step c (Transfer Step to High Pressure)

The Step in which the high-pressure control valve 11 is kept open. In this state, the working fluid in the pulse tube 3 continuously flows out to the buffer 5 through the orifice 4, and the working fluid from the compressor 10 flows into the regenerator 1 via the high-pressure control valve 11, and into the pulse tube 3 while being cooled in the generator 1.

(4) Step d (First Half Step of Expansion)

The state in which the high-pressure and low-pressure control valves 11 and 12 are kept closed whereas the buffer side control valve 6 is kept open by closing the high-pressure control valve 11 and by opening the buffer side control valve 6. In this state, the working fluid in the pulse tube 3 flows into the buffer 5 through the orifice 4 and further into the auxiliary buffer 7 through the buffer side control valve 6. In this case, the pulse tube 3 and the auxiliary buffer 7 are in communication through the buffer side control valve 6 having a low pressure loss so that the pressure in the pulse tube 3 quickly drops from the maximum pressure to the pressure of the auxiliary buffer 7. As a result of this pressure drop, the working fluid in the pulse tube 3 adiabatically expands to lower its temperature.

(5) Step e (Second Half Step of Expansion)

The Step in which the low-pressure control valve 12 is opened whereas the buffer side control valve 6 is closed when the pressure in the pulse tube 3 falls from the maximum pressure to the buffer pressure. In this state, the low-pressure passage 19 and the pulse tube 3 come into communication, and the communication between the pulse tube 3 and the auxiliary buffer 7 is interrupted by closing the buffer side control valve 6, so that the pressure in the pulse tube 3 drops from the auxiliary buffer pressure to the minimum pressure. As a result, the working fluid in the pulse tube 3 further adiabatically expands to lower its temperature.

(6) Step f (Low-pressure Transfer Step)

The state in which the low-pressure control valve 12 is kept open. In this state, the working fluid in the buffer 5 continuously flows into the pulse tube 3 through the orifice 4, and the cold working fluid in the pulse tube 3 cools the cold head 2 and the regenerator 1 and flows out from the low-pressure control valve 12 to the compressor 10.

Figure 3:
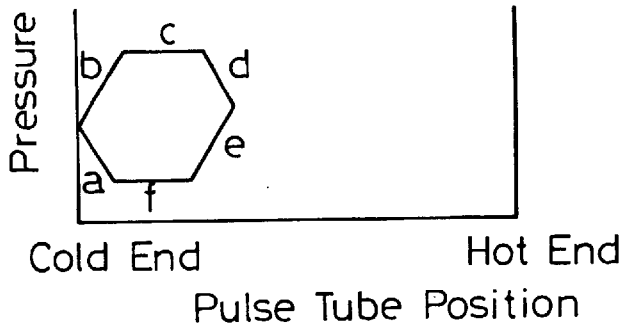
FIG. 3 is an equivalent PV diagram of a working fluid in the vicinity of a pulse tube cold end in the pulse tube refrigerator of the first embodiment of the invention.

The foregoing Steps a to f comprise one cycle and are repeated to establish such a state change in the working fluid as is illustrated in the equivalent PV diagram of FIG. 3, to establish an extremely low temperature in the cold head 2.

In this embodiment, the pulse tube refrigerator 101 is constructed to include: the regenerator 1 having the cold end 1*a* and the hot end 1*b*; the cold head 2 connecting to the cold end 1*a* of the regenerator 1; the pulse tube 3 having the cold end 3*a* and the hot end 3*b* and connected at its cold end 3*a* to the cold head 2; the pressure fluctuation source 21 connected to the hot end 1*b* of the regenerator 1; the buffer 5 connected to the hot end 3*b* of the pulse tube 3 through the orifice 4; and the auxiliary buffer 7 connected to the hot end 3*b* of the pulse tube 3 through the buffer side control valve 6. As a result, the pressure in the pulse tube 3 can be quickly raised or lowered to the auxiliary buffer pressure by opening the buffer side control valve 6 at Step a (or the first half Step of compression) and Step d (or the first half Step of expansion). This makes it possible to shorten the time period required for Steps a and d. At Step c (or the transfer Step to high pressure) and Step f (or the transfer Step to low pressure). On the other hand, the working fluid in the pulse tube can be introduced exclusively into the buffer 5 through the orifice 4 by closing the buffer side control valve 6 so that Steps c and f can take a long time. The heat loss at Steps c and f can be reduced while retaining the effects of Steps a and d sufficiently, to realize a high efficient operation of the pulse tube refrigerator.

The pressure fluctuation source 21 is constructed to include: the compressor 10; the high-pressure control valve 11 connected to the outlet port 10*a* of the compressor 10 through the high-pressure passage 18; the low-pressure control valve 12 connected to the inlet port 10*b* of the compressor 10 through the low-pressure passage 19; and the connection passage 20 connecting the high-pressure control valve 11 and the low-pressure control valve 12 to the hot end 10*b* of the regenerator 1. As compared with the case using a reciprocating type compressor, the high-pressure control valve 11, the low-pressure control valve 12 and the buffer side control valve 6 can be easily mechanically synchronized as one unit.

[Second Embodiment]

Figure 4:
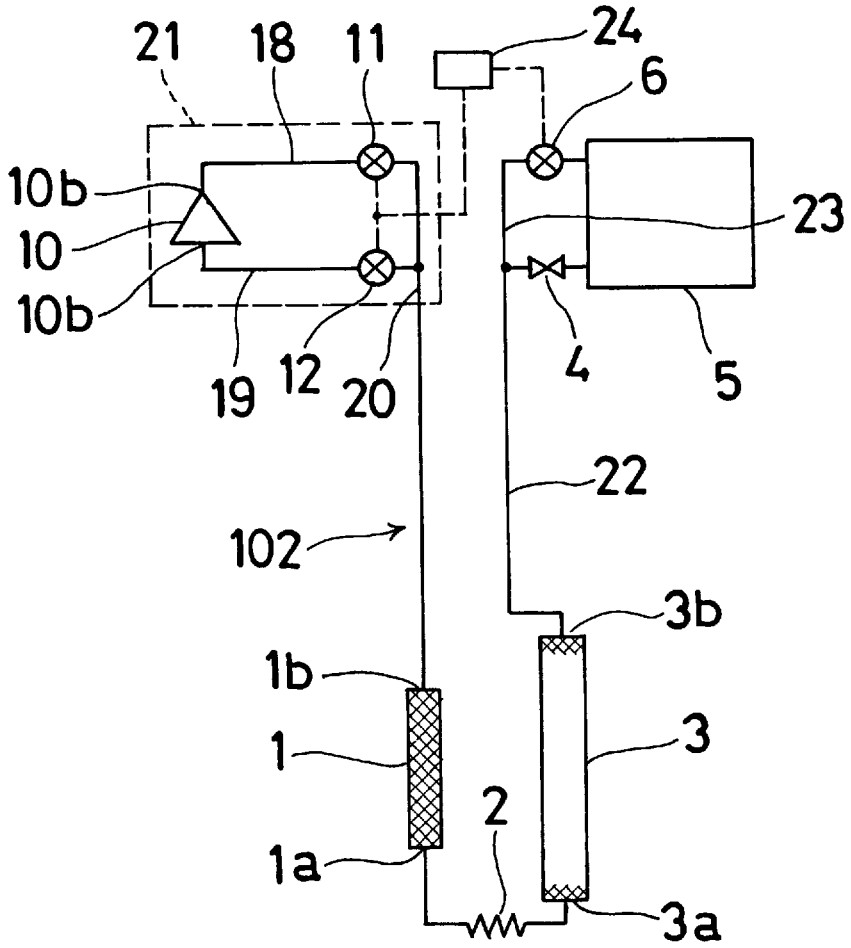
FIG. 4 is a schematic diagram showing the construction of a pulse tube refrigerator according to a second embodiment of the invention.
Figure 5:
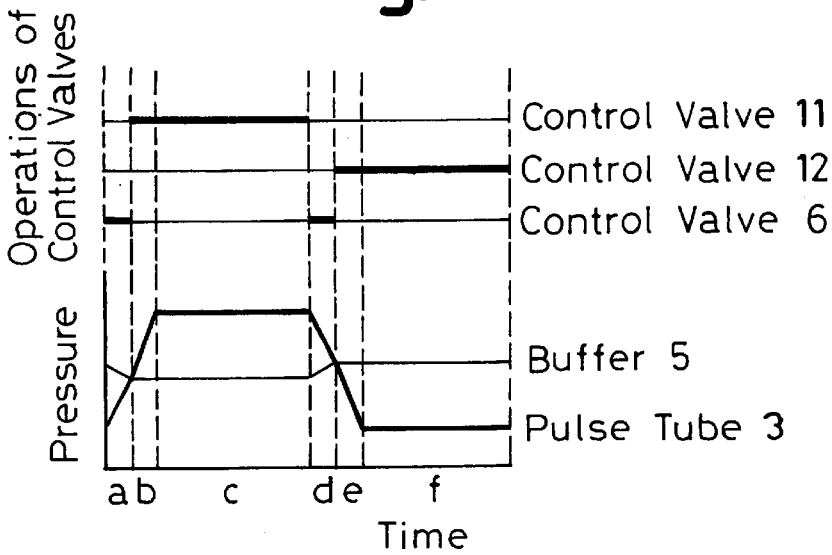
FIG. 5 is a graph illustrating the action states and pressure states of control valves of the pulse tube refrigerator in the second embodiment of the invention.

With reference to FIGS. 4 and 5, here will be described the second embodiment of the invention, which is different from the first embodiment only in the connection between the pulse tube hot end and the buffer but is identical to the first embodiment in the remaining points. The second embodiment will be described stressing the difference.

FIG. 4 is a schematic diagram showing a pulse tube refrigerator 102 of this embodiment. FIG. 5 is a graph illustrating both the controlled states (of which the opened states are indicated by thick lines and the closed states are indicated by thin lines) of the high-pressure control valve 11, the low-pressure control valve 12 and the buffer side control valve 6 over time when the pulse tube refrigerator 102 of FIG. 4 is operating, and the pressure states of the working fluid in the buffer 5 and the pulse tube 3 over time. In FIG. 4, the buffer 5 is connected to the hot end 3*b* of the pulse tube 3 not only through the passage 22 having the orifice 4 but also through the branch passage 23 branched midway of the passage 22 and having the buffer side control valve 6. In other words, the buffer 5 is separately connected to the hot end 3*b* of the pulse tube 3 through the orifice 4 and the buffer side control valve 6 arranged in parallel, so that the buffer 5 and the auxiliary buffer 7 of the first embodiment are commonly exemplified by the single buffer. The description of the remaining construction will be omitted because it is identical to that of the first embodiment.

The operation of the pulse tube refrigerator 102 thus constructed will be described with reference to FIG. 5. In this embodiment, the operation states of the pulse tube refrigerator 102 and the states of the internal working fluid accompanying the operations, are also divided in terms of the time into the following six Steps a to f.

(1) Step a (First Half Step of Compression)

The state in which the high-pressure and low-pressure control valves 11 and 12 are kept closed whereas the buffer side control valve 6 is kept open by closing the low-pressure control valve 12 and by opening the buffer side control valve 6. In this state, the working fluid in the buffer 5 flows from the branch passage 22 into the pulse tube 3 through the orifice 4 and further from the branch passage 23 into the pulse tube 3 through the buffer side control valve 6. In this case, the buffer 5 and the pulse tube 3 are in communication with each other through the buffer side control valve having a low pressure loss so that the pressure in the pulse tube 3 quickly rises from the minimum pressure to the pressure of the buffer 5.

(2) Step b (Second Half Step of Compression)

The state in which the high-pressure control valve 11 is opened whereas the buffer side control valve 6 is closed when the pressure in the pulse tube 3 rises from the minimum pressure to the buffer pressure. In this state, the high-pressure passage 18 and the pulse tube 3 come into communication, but the communication through the branch passage 23 between the pulse tube 3 and the buffer 5 is interrupted by closing the buffer side control valve 6, so that the pressure in the pulse tube 3 rises from the buffer pressure to the maximum pressure.

(3) Step c (Transfer Step to High Pressure)

The Step in which the high-pressure control valve 11 is kept open. In this state, the working fluid in the pulse tube 3 continuously flows out to the buffer 5 through the orifice 4, and the working fluid from the compressor 10 flows into the regenerator 1 via the high-pressure control valve 11, and into the pulse tube 3 while being cooled in the regenerator 1.

(4) Step d (First Half Step of Expansion)

The state in which the high-pressure and low-pressure control valves 11 and 12 are kept closed whereas the buffer side control valve 6 is kept open by closing the high-pressure control valve 11 and by opening the buffer side control valve 6. In this state, the working fluid in the pulse tube 3 flows from the passage 22 into the buffer 5 through the orifice 4 and further from the branch passage 23 into the buffer 5 through the buffer side control valve 6. In this case, the pulse tube 3 and the buffer 5 are in communication through the buffer side control valve 6 having a low pressure loss so that the pressure in the pulse tube 3 quickly drops from the maximum pressure to the pressure of the buffer 5. As a result of this pressure drop, the working fluid in the pulse tube 3 adiabatically expands to lower its temperature.

(5) Step e (Second Half Step of Expansion)

The Step in which the low-pressure control valve 12 is opened whereas the buffer side control valve 6 is closed when the pressure in the pulse tube 3 falls from the maximum pressure to the buffer pressure. In this state, the low-pressure passage 19 and the pulse tube 3 come into communication, and the communication through the branch passage 23 between the pulse tube 3 and the buffer 5 is interrupted, so that the pressure in the pulse tube 3 drops from the buffer pressure to the minimum pressure. As a result, the working fluid in the pulse tube 3 further adiabatically expands to lower its temperature.

(6) Step f (Low-pressure Transfer Step)

The state in which the low-pressure control valve 12 is kept open. In this state, the working fluid in the buffer 5 continuously flows into the pulse tube 3 through the orifice 4, and the cold working fluid in the pulse tube 3 cools the cold head 2 and the regenerator 1 and flows out from the low-pressure control valve 12 to the compressor 10.

The foregoing Steps a to f comprise one cycle and are repeated to establish an extremely low temperature in the cold head 2.

In this embodiment, the pulse tube refrigerator 102 is constructed to include: the regenerator 1 having the cold end 1*a* and the hot end 1*b*; the cold head 2 connecting to the cold end 1*a* of the regenerator 1; the pulse tube 3 having the cold end 3*a* and the hot end 3*b* and connected at its cold end 3*a* to the cold head 2; the pressure fluctuation source 21 connected to the hot end 1*b* of the regenerator 1; and the buffer 5 connected to the hot end 3*b* of the pulse tube 3 through the orifice 4 and the buffer side control valve 6 arranged in parallel. As a result, the pressure in the pulse tube 3 can be quickly raised or lowered to the buffer pressure by opening the buffer side control valve 6 at Step a (or the first half Step of compression) and Step d (or the first half Step of expansion). This makes it possible to shorten the time period required for Steps a and d. At Step c (or the transfer Step to high pressure) and Step f (or the transfer Step to low pressure), on the other hand, the working fluid in the pulse tube is introduced into the buffer 5 through the orifice 4 by closing the buffer side control valve 6 so that Steps c and f can take a long time. The heat loss at Steps c and f can be reduced while retaining the effects of Steps a and d sufficiently, to realize a high efficient operation of the pulse tube refrigerator.

Unlike the first embodiment, the buffer connected to the hot end 3*b* of the pulse tube 3 through the orifice and the auxiliary buffer connected through the buffer side control valve are commonly exemplified by a single buffer so that the refrigerator can be made compact.

[Third Embodiment]

Figure 6:
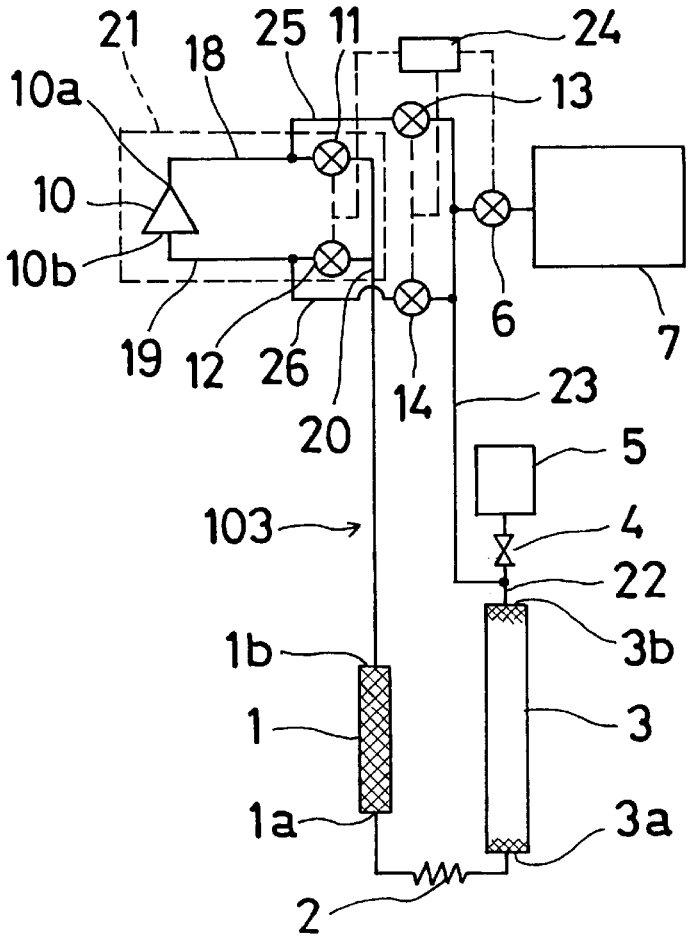
FIG. 6 is a schematic diagram showing the construction of a pulse tube refrigerator according to a third embodiment of the invention.
Figure 7:
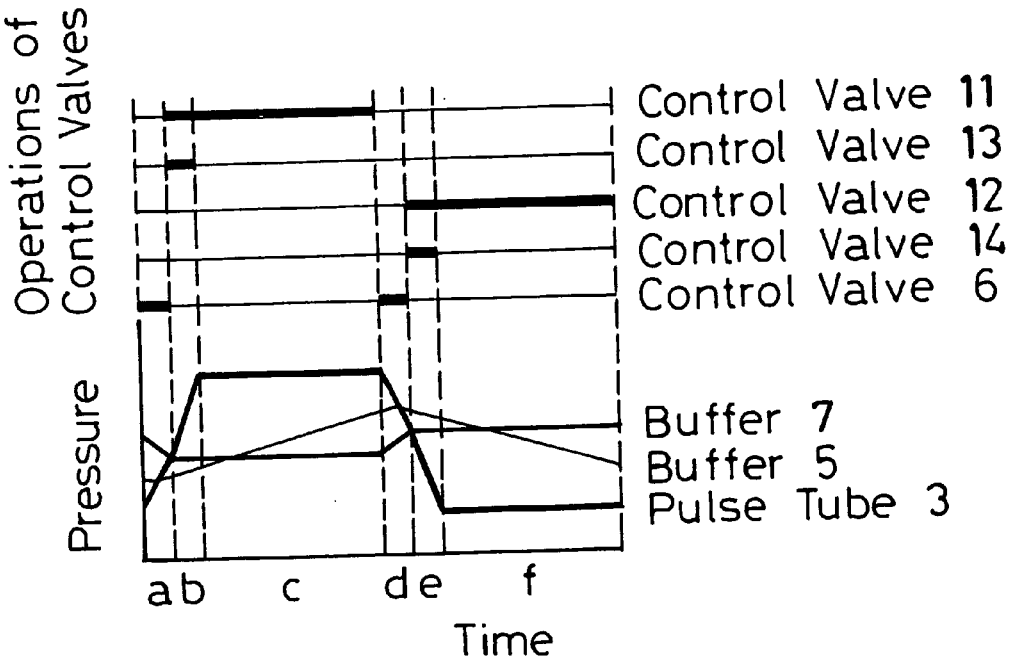
FIG. 7 is a graph illustrating the action states and pressure states of control valves of the pulse tube refrigerator in the third embodiment of the invention.
Figure 8:
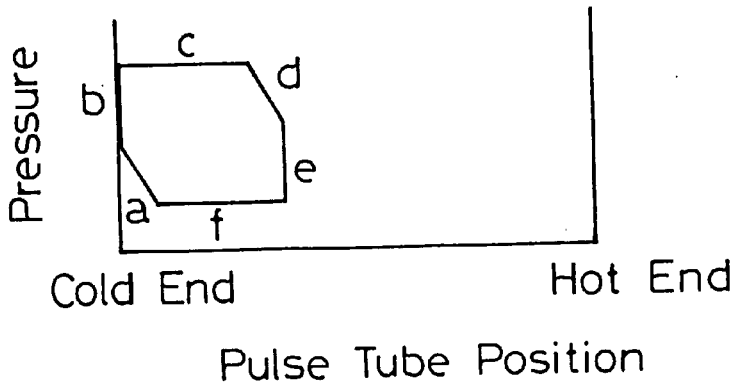
FIG. 8 is an equivalent PV diagram of a working fluid in the vicinity of a pulse tube cold end in the pulse tube refrigerator of the third embodiment of the invention.

With reference to FIGS. 6, 7 and 8, here will be described the third embodiment of the invention, in which a construction of connecting the pressure fluctuation source and the pulse tube hot end is added to the aforementioned construction of the first embodiment. The third embodiment will be described stressing the added construction.

FIG. 6 is a schematic diagram showing a pulse tube refrigerator 103 according to this embodiment. To the mid-portion of the high-pressure passage 18 connecting the outlet port 10*a* of the compressor 10 and the high-pressure control valve 11, as shown in FIG. 6, there is connected one end of a high-pressure second passage 25 which has a high-pressure second control valve 13 in its mid-portion and which is connected at its other end to the branch passage 23. To the mid-portion of the low-pressure passage 19 connecting the inlet port 10*b* of the compressor 10 and the low-pressure control valve 12, on the other hand, there is connected one end of a low-pressure second passage 26 which has a low-pressure second control valve 14 in its mid-portion and which is connected at its other end to the branch passage 23. In other words, the high-pressure working fluid in the high-pressure passage 18 can flow from the high-pressure second passage 25 having the high-pressure second control valve 13 into the branch passage 23 and further from the branch passage 23 into the hot end 3*b* of the pulse tube 3, and the low-pressure working fluid in the low-pressure passage 19 can flow from the low-pressure second passage 26 having the low-pressure second control valve 14 into the branch passage 23 and further from the branch passage 23 into the hot end 3*b* of the pulse tube 3.

The high-pressure control valve 11, the low-pressure control valve 12, the high-pressure second control valve 13, the low-pressure second control valve 14 and the buffer side control valve 6 are individually controlled to open/close by the control unit 24. The control unit 24 may be exemplified by various modes such as a 3-input 2-output rotary valve unit having a high-pressure inlet (connected to the high-pressure passage 18), a low-pressure inlet (connected to the low-pressure passage 19), a buffer pressure inlet (connected to the branch passage 23 between the buffer side control valve 6 and the auxiliary buffer 7), a regenerator side outlet (connected to the regenerator hot end 1*b*) and a pulse tube side outlet (connected to the pulse tube hot end 3*b*). In this rotary valve unit, the high-pressure control valve 11, the low-pressure control valve 12, the high-pressure second control valve 13, the low-pressure second control valve 14 and the buffer side control valve 6 may be mechanically controlled to open/close by constructing them with the control unit 24. Alternatively, the high-pressure control valve 11, the low-pressure control valve 12, the high-pressure second control valve 13, the low-pressure second control valve 14 and the buffer side control valve 6 may be solenoid valves which are electrically controlled to open/close by the control unit 24.

The construction of the pulse tube refrigerator 103 and the description of other portions will be omitted because they are identical to those of the first embodiment.

FIG. 7 is a graph illustrating the controlled states (of which the opened states are indicated by thick lines and the closed states are indicated by thin lines) of the high-pressure control valve 11, the low-pressure control valve 12, the high-pressure second control valve 13, the low-pressure second control valve 14 and the buffer side control valve 6 over time when the pulse tube refrigerator 103 of FIG. 6 is operating, and the pressure states of the working fluid in the buffer 5, the auxiliary buffer 7 and the pulse tube 3 over time. FIG. 8 is an equivalent PV diagram illustrating the relation between the displacement and the pressure of the working fluid in the vicinity of the cold end 3*a* of the pulse tube 3.

The operation of the pulse tube refrigerator 103 thus constructed will be described for Steps a to f with reference to FIG. 7.

(1) Step a (First Half Step of Compression)

The state in which the high-pressure control valve 11, the low-pressure control valve 12, the high-pressure second control valve 13 and the low-pressure second control valve 14 are kept closed, whereas the buffer side control valve 6 is exclusively kept open by closing the low-pressure control valve 12 and by opening the buffer side control valve 6. In this state, the working fluid in the buffer 5 flows into the pulse tube 3 through the orifice 4, and the working fluid in the auxiliary buffer 7 also flows into the pulse tube 3 through the buffer side control valve 6. In this case, the auxiliary buffer 7 and the pulse tube 3 are in communication with each other through the buffer side control valve 6 having a low pressure loss so that the pressure in the pulse tube 3 quickly rises from the minimum pressure to the pressure of the auxiliary buffer 7.

(2) Step b (Second Half Step of Compression)

The state in which the high-pressure control valve 11 and the high-pressure second control valve 13 are opened, whereas the buffer side control valve 6 is closed when the pressure in the pulse tube 3 rises from the minimum pressure to the auxiliary buffer pressure. In this state, the high-pressure passage 18 and the pulse tube 3 come into communication, but the communication between the pulse tube 3 and the auxiliary buffer 7 is interrupted by closing the buffer side control valve 6, so that the pressure in the pulse tube 3 rises from the auxiliary buffer pressure to the maximum pressure. At this time, the communication between the high-pressure passage 18 and the pulse tube 3 is via two passages: the passage from the high-pressure passage 18 to the pulse tube cold end 3*a* through the high-pressure control valve 11, the connection passage 20, the regenerator 1 and the cold head 2; and the passage from the high-pressure passage 18 to the pulse tube hot end 3*b* through the high-pressure second passage 25, the high-pressure second control valve 13 and the branch passage 23. Thus, the pulse tube 3 is exposed to the pressure from both the cold end 3*a* and the hot end 3*b*, thereby to suppress displacement of the working fluid in the vicinity of the pulse tube cold end 3*a*.

(3) Step c (Transfer Step to High Pressure)

The Step in which the high-pressure control valve 11 is kept open by closing the high-pressure second control valve 13. In this state, the working fluid in the pulse tube 3 continuously flows out to the buffer 5 through the orifice 4, and the working fluid from the compressor 10 flows into the regenerator 1 via the high-pressure control valve 11 and flows into the pulse tube 3 while being cooled in the regenerator 1.

(4) Step d (First Half Step of Expansion)

The state in which the high-pressure and low-pressure control valves 11 and 12 are kept closed whereas the buffer side control valve 6 is kept open by closing the high-pressure control valve 11 and by opening the buffer side control valve 6. In this state, the working fluid in the pulse tube 3 flows into the buffer 5 through the orifice 4 and further into the auxiliary buffer 7 through the buffer side control valve 6. In this case, the pulse tube 3 and the auxiliary buffer 7 are in communication through the buffer side control valve 6 having a low pressure loss so that the pressure in the pulse tube 3 quickly drops from the maximum pressure to the pressure of the auxiliary buffer 7. As a result of this pressure drop, the working fluid in the pulse tube 3 adiabatically expands to lower its temperature.

(5) Step e (Second Half Step of Expansion)

The Step in which the low-pressure control valve 12 and the low-pressure second control valve 14 are opened whereas the buffer side control valve 6 is closed when the pressure in the pulse tube 3 falls from the maximum pressure to the buffer pressure. In this state, the low-pressure passage 19 and the pulse tube 3 come into communication, and the communication between the pulse tube 3 and the auxiliary buffer 7 is interrupted by closing the buffer side control valve 6, so that the pressure in the pulse tube 3 drops from the auxiliary buffer pressure to the minimum pressure. As a result, the working fluid in the pulse tube 3 further adiabatically expands to lower its temperature. At this time, the communication between the low-pressure passage 19 and the pulse tube 3 is via two passages: the passage from the low-pressure passage 19 to the pulse tube cold end 3*a* through the low-pressure control valve 12, the connection passage 20, the regenerator 1 and the cold head 2; and the passage from the low-pressure passage 19 to the pulse tube hot end 3*b* through the low-pressure second passage 26, the low-pressure second control valve 14 and the branch passage 23. Thus, the pulse tube 3 is released from the pressure at both the cold end 3*a* and the hot end 3*b*, thereby to suppress displacement of the working fluid in the vicinity of the pulse tube cold end 3*a*.

(6) Step f (Low-pressure Transfer Step)

The state in which the low-pressure control valve 12 is kept open by closing the low-pressure second control valve 14. In this state, the working fluid in the buffer 5 continuously flows into the pulse tube 3 through the orifice 4, and the cold working fluid in the pulse tube 3 cools the cold head 2 and the regenerator 1 and flows out from the low-pressure control valve 12 to the compressor 10.

The foregoing Steps a to f comprise one cycle and are repeated to establish such a state change in the working fluid as is illustrated in the equivalent PV diagram of FIG. 8, to establish an extremely low temperature in the cold head 2.

In this embodiment, the hot end 3*b* of the pulse tube 3 is connected to both the buffer 5 having the orifice 4 and the auxiliary buffer 7 having the buffer side control valve 6. As a result, the pressure in the pulse tube 3 can be quickly raised or lowered to the auxiliary buffer pressure by opening the buffer side control valve 6 at Step a (or the first half Step of compression) and Step d (or the first half Step of expansion). This makes it possible to shorten the time period required for Steps a and d. At Step c (or the transfer Step to high pressure) and Step f (or the transfer Step to low pressure), on the other hand, the working fluid in the pulse tube 3 is introduced into the buffer 5 through the orifice 4 by closing the buffer side control valve 6 so that Steps c and f can take a long time. The heat loss at Steps c and f can be reduced while retaining the effects of Steps a and d sufficiently, to realize a high efficient operation of the pulse tube refrigerator.

At Step b (or the second half Step of compression), on the other hand, communication between the high-pressure passage 18 and the pulse tube 3 is via two passages: the passage from the high-pressure passage 18 to the pulse tube cold end 3*a* through the high-pressure control valve 11, the connection passage 20, the regenerator 1 and the cold head 2; and the passage from the high-pressure passage 18 to the pulse tube hot end 3*b* through the high-pressure second passage 25, the high-pressure second control valve 13 and the branch passage 23, so that the pressures at the cold end 3*a* and the hot end 3*b* are applied to the pulse tube 3. Thus, the pulse tube 3 is exposed to the pressure from both the cold end 3*a* and the hot end 3*b*, thereby to suppress displacement of the working fluid in the vicinity of the pulse tube cold end 3*a*. This is clearly seen from the equivalent PV diagram of FIG. 8. In FIG. 8, more specifically, the working fluid in the vicinity of the pulse tube cold end 3*a* at Step b is hardly changed in position even if the pressure rises. This makes it possible to enlarge the area of the region, as enclosed by the equivalent PV diagram, thereby to improve the efficiency of the pulse tube refrigerator.

At Step e (or the second half Step of expansion), likewise, the communication between the low-pressure passage 19 and the pulse tube 3 is via two passages: the passage from the low-pressure passage 19 to the pulse tube cold end 3*a* through the low-pressure control valve 12, the connection passage 20, the regenerator 1 and the cold head 2; and the passage from the low-pressure passage 19 to the pulse tube hot end 3*b* through the low-pressure second passage 26, the low-pressure second control valve 14 and the branch passage 23. Thus, the pulse tube 3 is released from the pressure at both the cold end 3*a* and the hot end 3*b*, thereby to suppress displacement of the working fluid in the pulse tube 3. As shown in FIG. 8, therefore, the working fluid in the vicinity of the pulse tube cold end 3*a* at Step e is hardly changed in position even if the pressure falls. This makes it possible to enlarge the area of the region enclosed by the equivalent PV diagram, thereby to improve the efficiency of the pulse tube refrigerator.

[Fourth Embodiment]

Figure 9:
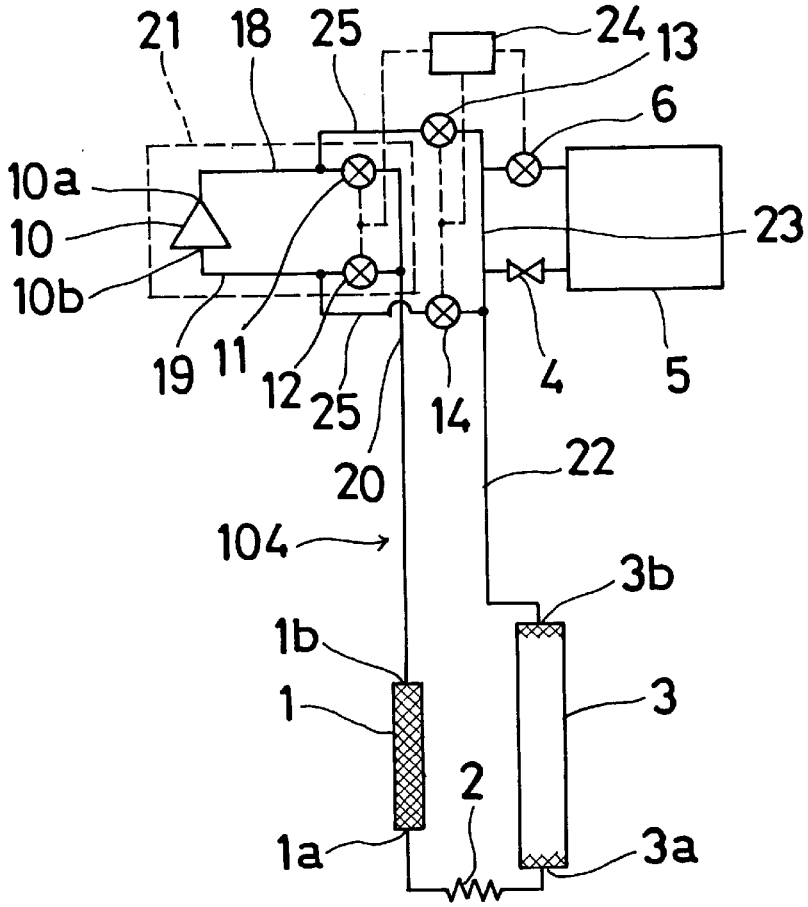
FIG. 9 is a schematic diagram showing the construction of a pulse tube refrigerator according to a fourth embodiment of the invention.
Figure 10:
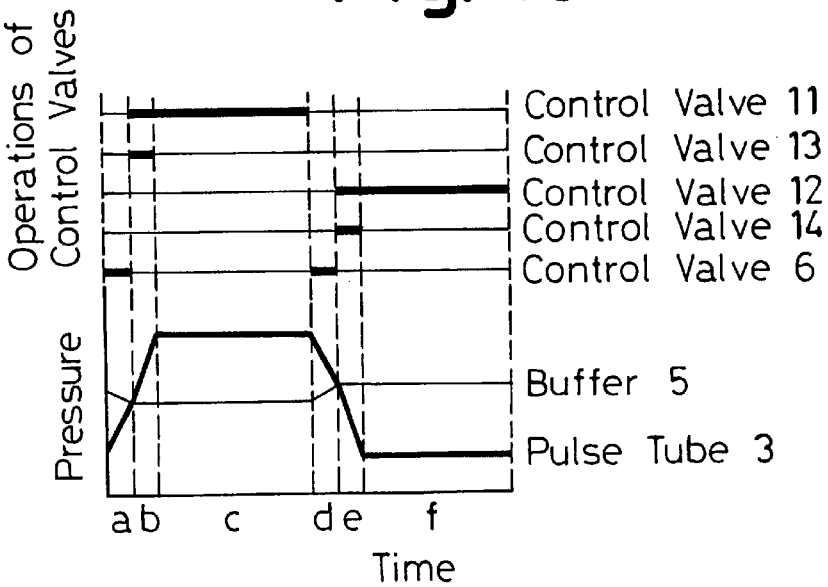
FIG. 10 is a graph illustrating the action states and pressure states of control valves of the pulse tube refrigerator in the fourth embodiment of the invention.

With reference to FIGS. 9 and 10, here will be described the fourth embodiment of the invention, which is different from the third embodiment only in the connection between the pulse tube hot end and the buffer but is identical to the third embodiment in the remaining points. The fourth embodiment will be described stressing the difference.

FIG. 9 is a schematic diagram showing a pulse tube refrigerator 104 of this embodiment. FIG. 10 is a graph illustrating the controlled states (of which the opened states are indicated by thick lines and the closed states are indicated by thin lines) of the high-pressure control valve 11, the low-pressure control valve 12, the high-pressure second control valve 13, the low-pressure second control valve 14 and the buffer side control valve 6 over time when the pulse tube refrigerator 104 of FIG. 9 is operating, and the pressure states of the working fluid in the buffer 5 and the pulse tube 3 over time. In FIG. 9, the buffer 5 is connected to the hot end 3*b* of the pulse tube 3 not only through the passage 22 having the orifice 4 but also through the branch passage 23 branched midway of the passage 22 and having the buffer side control valve 6. In other words, the buffer 5 is connected to the hot end 3*b* of the pulse tube 3 individually through the orifice 4 and the buffer side control valve 6 arranged in parallel, so that the buffer 5 and the auxiliary buffer 7 of the third embodiment are commonly embodied by single buffer. The description of the remaining construction will be omitted because it is identical to that of the third embodiment.

The operation of the pulse tube refrigerator 104 thus constructed will be described for the individual Steps a to f with reference to FIG. 10.

(1) Step a (First Half Step of Compression)

The state in which the high-pressure control valve 11, the low-pressure control valve 12, the high-pressure second control valve 13 and the low-pressure second control valve 14 are kept closed, whereas the buffer side control valve 6 is exclusively kept open by closing the low-pressure control valve 12 and by opening the buffer side control valve 6. In this state, the working fluid in the buffer 5 flows from the passage 22 into the pulse tube 3 through the orifice 4 and further from the branch passage 23 into the pulse tube 3 through the buffer side control valve 6. In this case, the buffer 5 and the pulse tube 3 are in communication with each other through the buffer side control valve 6 having a low pressure loss so that the pressure in the pulse tube 3 quickly rises from the minimum pressure to the pressure of the buffer 5.

(2) Step b (Second Half Step of Compression)

The state in which the high-pressure control valve 11 and the high-pressure second control valve 13 are opened whereas the buffer side control valve 6 is closed when the pressure in the pulse tube 3 rises from the minimum pressure to the auxiliary buffer pressure. In this state, the high-pressure passage 18 and the pulse tube 3 come into communication, but the communication via the branch passage 23 between the pulse tube 3 and the buffer 5 is interrupted by closing the buffer side control valve 6, so that the pressure in the pulse tube 3 rises from the auxiliary buffer pressure to the maximum pressure. At this time, the communication between the high-pressure passage 18 and the pulse tube 3 is via two passages: the passage from the high-pressure passage 18 to the pulse tube cold end 3*a* through the high-pressure control valve 11, the connection passage 20, the regenerator 1 and the cold head 2; and the passage from the high-pressure passage 18 to the pulse tube hot end 3*b* through the high-pressure second passage 25, the high-pressure second control valve 13 and the branch passage 23. Thus, the pulse tube 3 is exposed to the pressure at both the cold end 3*a* and the hot end 3*b*, thereby to suppress displacement of the working fluid in the vicinity of the pulse tube cold end 3*a*.

(3) Step c (Transfer Step to High Pressure)

The Step in which the high-pressure control valve 11 is kept open by closing the high-pressure second control valve 13. In this state, the working fluid in the pulse tube 3 continuously flows out to the buffer 5 through the orifice 4, and the working fluid from the compressor 10 flows into the regenerator 1 via the high-pressure control valve 11 and into the pulse tube 3 while being cooled in the regenerator 1.

(4) Step d (First Half Step of Expansion)

The state in which the high-pressure and low-pressure control valves 11 and 12 are kept closed whereas the buffer side control valve 6 is kept open by closing the high-pressure control valve 11 and by opening the buffer side control valve 6. In this state, the working fluid in the pulse tube 3 flows from the passage 22 into the buffer 5 through the orifice 4 and further from the branch passage 23 into the buffer 5 through the buffer side control valve 6. In this case, the pulse tube 3 and the buffer are in communication through the buffer side control valve 6 having a low pressure loss so that the pressure in the pulse tube 3 quickly drops from the maximum pressure to the pressure of the buffer 5. As a result of this pressure drop, the working fluid in the pulse tube 3 adiabatically expands to lower its temperature.

(5) Step e (Second Half Step of Expansion)

The Step in which the low-pressure control valve 12 and the low-pressure second control valve 14 are opened whereas the buffer side control valve 6 is closed when the pressure in the pulse tube 3 falls from the maximum pressure to the buffer pressure. In this state, the low-pressure passage 19 and the pulse tube 3 come into communication, and the communication via the branch passage 23 between the pulse tube 3 and the buffer 5 is interrupted by closing the buffer side control valve 6, so that the pressure in the pulse tube 3 drops from the buffer pressure to the minimum pressure. As a result, the working fluid in the pulse tube 3 further adiabatically expands to lower its temperature. At this time, the communication between the low-pressure passage 19 and the pulse tube 3 is via two passages: the passage from the low-pressure passage 19 to the pulse tube cold end 3*a* through the low-pressure control valve 12, the connection passage 20, the regenerator 1 and the cold head 2; and the passage from the low-pressure passage 19 to the pulse tube hot end 3*b* through the low-pressure second passage 26, the low-pressure second control valve 14 and the branch passage 23. Thus, the pulse tube 3 is released from the pressure at both the cold end 3*a* and the hot end 3*b*, thereby to suppress displacement of the working fluid in the vicinity of the pulse tube cold end 3*a*.

(6) Step f (Low-pressure Transfer Step)

The state in which the low-pressure control valve 12 is kept open by closing the low-pressure second control valve 14. In this state, the working fluid in the buffer 5 continuously flows into the pulse tube 3 through the orifice 4, and the cold working fluid in the pulse tube 3 cools the cold head 2 and the regenerator 1 and flows out from the low-pressure control valve 12 to the compressor 10.

The foregoing Steps a to f comprise one cycle and are repeated to establish an extremely low temperature in the cold head 2.

In this embodiment as in the third embodiment, at Step b (or the second half Step of compression), on the other hand, the communication between the high-pressure passage 18 and the pulse tube 3 is via two passages: the passage from the high-pressure passage 18 to the pulse tube cold end 3*a* through the high-pressure control valve 11, the connection passage 20, the regenerator 1 and the cold head 2; and the passage from the high-pressure passage 18 to the pulse tube hot end 3*b* through the high-pressure second passage 25, the high-pressure second control valve 13 and the branch passage 23. At Step e (or the second half Step of expansion), likewise, the communication between the low-pressure passage 19 and the pulse tube 3 is via two passages: the passage from the low-pressure passage 19 to the pulse tube cold end 3*a* through the low-pressure control valve 12, the connection passage 20, the regenerator 1 and the cold head 2; and the passage from the low-pressure passage 19 to the pulse tube hot end 3*b* through the low-pressure second passage 26, the low-pressure second control valve 14 and the branch passage 23. As a result, the pulse tube 3 is influenced by the pressure change at the cold end 3*a* and the hot end 3*b*. Thus, the pulse tube 3 is influenced by the pressure change at both sides, thereby to suppress displacement of the working fluid in the pulse tube 3 during the pressure rise or drop. As a result, the equivalent PV diagram of the working fluid in the pulse tube 3 as obtained in this embodiment is similar to that of the third embodiment, as shown in FIG. 8, thereby to improve efficiency of the pulse tube refrigerator.

[Fifth Embodiment]

Figure 11:
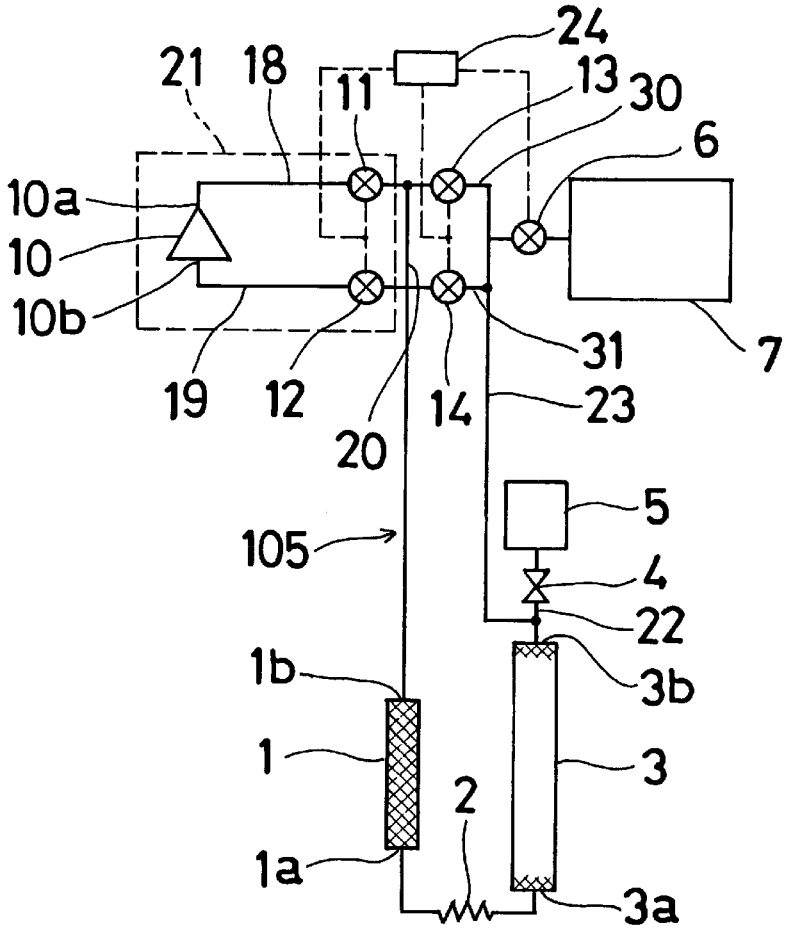
FIG. 11 is a schematic diagram showing the construction of a pulse tube refrigerator according to a fifth embodiment of the invention.
Figure 12:
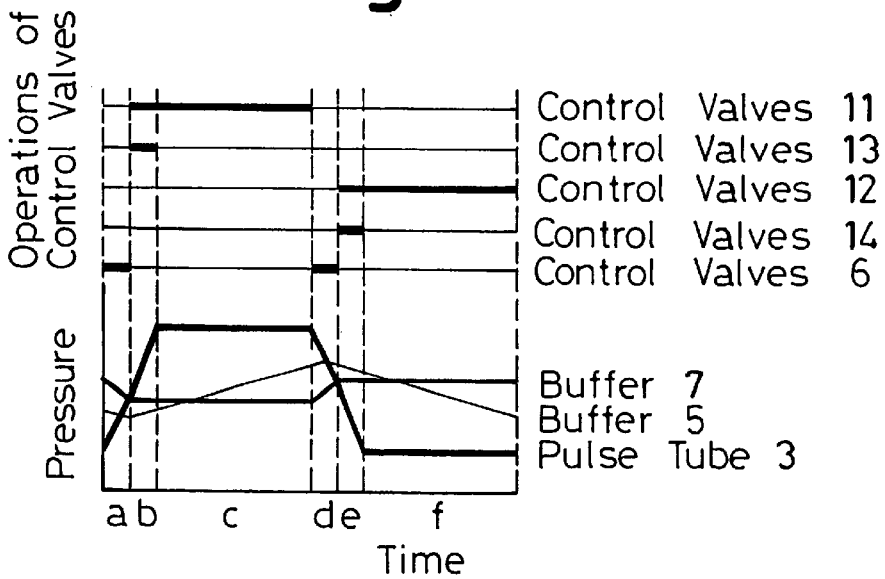
FIG. 12 is a graph illustrating the action states and pressure states of control valves of the pulse tube refrigerator in the fifth embodiment of the invention.

With reference to FIGS. 11 and 12, here will be described the fifth embodiment of the invention, in which a construction of connecting the pressure fluctuation source and the pulse tube hot end in a mode different from that of the third embodiment is added to the aforementioned construction of the first embodiment. The fifth embodiment will be described stressing the added construction.

FIG. 11 is a schematic diagram showing a pulse tube refrigerator 105 of this embodiment. FIG. 12 is a graph illustrating both the controlled states (of which the opened states are indicated by thick lines and the closed states are indicated by thin lines) of the high-pressure control valve 11, the low-pressure control valve 12, the high-pressure second control valve 13, the low-pressure second control valve 14 and the buffer side control valve 6 over time when the pulse tube refrigerator 105 of FIG. 11 is operating, and the pressure states of the working fluid in the buffer 5 and the pulse tube 3 over time. In FIG. 11, the connection passage 20, as connecting the high-pressure control valve 11 and the low-pressure control valve 12 to the hot end 1*b* of the regenerator 1, and the branch passage 23, as branched from the passage 22 connecting the hot end 3*b* of the pulse tube 3 and the orifice 4, are connected not only via a high-pressure connection passage 30 having the high-pressure second control valve 13 but also via a low-pressure connection passage 31 having the low-pressure second control valve 14. In the foregoing third embodiment, more specifically, the high-pressure second passage 25 and the low-pressure second passage 26, as connected directly to the high-pressure passage 18 and the low-pressure passage 19, are connected to the pulse tube hot end 3*b*. In this embodiment, on the other hand, the connection passage 20 is connected to the pulse tube hot end 3*b* via the high-pressure connection passage 30 and the low-pressure connection passage 31. As a result, when both the high-pressure control valve 11 and the high-pressure second control valve 13 are opened, the high-pressure passage 18 is connected to the hot end 3*b* of the pulse tube 3 through the high-pressure control valve 11, the connection passage 20, the high-pressure connection passage 30 having the high-pressure second control valve 13, the branch passage 23 and the passage 22. When both the low-pressure control valve 12 and the low-pressure second control valve 14 are opened, the low-pressure passage 19 is connected to the hot end 3*b* of the pulse tube 3 through the low-pressure control valve 12, the connection passage 20, the low-pressure connection passage 31 having the low-pressure second control valve 14, the branch passage 23 and the passage 22.

In the description of the pulse tube refrigerator 105, the description of other portions will be omitted because they are identical to those of the third embodiment.

The operation (e.g., the controls of the individual control valves) of the pulse tube refrigerator 105 thus constructed will be described for the individual Steps a to f.

(1) Step a (First Half Step of Compression)

The state in which the high-pressure control valve 11, the low-pressure control valve 12, the high-pressure second control valve 13 and the low-pressure second control valve 14 are kept closed whereas the buffer side control valve 6 is exclusively kept open by closing the low-pressure control valve 12 and by opening the buffer side control valve 6. In this state, the working fluid in the buffer 5 flows into the pulse tube 3 through the orifice 4, and the working fluid in the auxiliary buffer 7 flows into the pulse tube 3 through the buffer side control valve 6. In this case, the auxiliary buffer 7 and the pulse tube 3 are in communication with each other through the buffer side control valve 6 having a low pressure loss so that the pressure in the pulse tube 3 quickly rises from the minimum pressure to the pressure of the auxiliary buffer 7.

(2) Step b (Second Half Step of Compression)

The state in which the high-pressure control valve 11 and the high-pressure second control valve 13 are opened whereas the buffer side control valve 6 is closed when the pressure in the pulse tube 3 rises from the minimum pressure to the auxiliary buffer pressure. In this state, the high-pressure passage 18 and the pulse tube 3 come into communication, but the communication between the pulse tube 3 and the auxiliary buffer 7 is interrupted by closing the buffer side control valve 6 so that the pressure in the pulse tube 3 rises from the auxiliary buffer pressure to the maximum pressure. At this time, the communication between the high-pressure passage 18 and the pulse tube 3 is via two passages: the passage from the high-pressure passage 18 to the pulse tube cold end 3*a* through the high-pressure control valve 11, the connection passage 20, the regenerator 1 and the cold head 2; and the passage from the high-pressure passage 18 to the hot end 3*b* of the pulse tube 3 via the high-pressure control valve 11, the connection passage 20, the high-pressure connection passage 30 having the high-pressure second control valve 13, the branch passage 23 and the passage 22. Thus, the pulse tube 3 is exposed to pressure at both the cold end 3*a* and the hot end 3*b*, thereby to suppress displacement of the working fluid in the vicinity of the cold end 3*a* of the pulse tube 3.

(3) Step c (Transfer Step to High Pressure)

The Step in which the high-pressure control valve 11 is kept open by closing the high-pressure second control valve 13. In this state, the working fluid in the pulse tube 3 continuously flows out to the buffer 5 through the orifice 4, and the working fluid from the compressor 10 flows into the regenerator 1 via the high-pressure control valve 11, and into the pulse tube 3 while being cooled in the regenerator 1.

(4) Step d (First Half Step of Expansion)

The state in which the high-pressure and low-pressure control valves 11 and 12 are kept closed whereas the buffer side control valve is kept open by closing the high-pressure control valve 11 and by opening the buffer side control valve 6. In this state, the working fluid in the pulse tube 3 flows into the buffer 5 through the orifice 4 and further into the auxiliary buffer 7 through the buffer side control valve 6. In this case, the pulse tube 3 and the auxiliary buffer 7 are in communication through the buffer side control valve 6 having a low pressure loss so that the pressure in the pulse tube 3 quickly drops from the maximum pressure to the pressure of the auxiliary buffer 7. As a result of this pressure drop, the working fluid in the pulse tube 3 adiabatically expands to lower its temperature.

(5) Step e (Second Half Step of Expansion)

The Step in which the low-pressure control valve 12 and the low-pressure second control valve 14 are opened whereas the buffer side control valve 6 is closed when the pressure in the pulse tube 3 falls from the maximum pressure to the buffer pressure. In this state, the low-pressure passage 19 and the pulse tube 3 come into communication, and the communication between the pulse tube 3 and the auxiliary buffer 7 is interrupted by closing the buffer side control valve 6, so that the pressure in the pulse tube 3 drops from the auxiliary buffer pressure to the minimum pressure. As a result, the working fluid in the pulse tube 3 further adiabatically expands to lower its temperature. At this time, the communication between the low-pressure passage 19 and the pulse tube 3 is via two passages: the passage from the low-pressure passage 19 to the pulse tube cold end 3*a* through the low-pressure control valve 12, the connection passage 20, the regenerator 1 and the cold head 2; and the passage from the low-pressure passage 19 to the hot end 3*b* of the pulse tube 3 through the low-pressure control valve 12, the connection passage 20, the low-pressure connection passage 31 having the low-pressure second control valve 14, the branch passage 23 and the passage 22. Thus, the pulse tube 3 is released from the pressure at both the cold end 3*a* and the hot end 3*b*, thereby to suppress displacement of the working fluid in the vicinity of the pulse tube cold end 3*a*.

(6) Step f (Low-pressure Transfer Step)

The state in which the low-pressure control valve 12 is kept open by closing the low-pressure second control valve 14. In this state, the working fluid in the buffer 5 continuously flows into the pulse tube 3 through the orifice 4, and the cold working fluid in the pulse tube 3 cools the cold head 2 and the regenerator 1 and flows out from the low-pressure control valve 12 to the compressor 10.

The foregoing Steps a to f comprise one cycle and are repeated to establish such a state change in the working fluid as is illustrated in the equivalent PV diagram of FIG. 8, to establish an extremely low temperature in the cold head 2.

The equivalent PV diagram of the working fluid in the vicinity of the cold end of the pulse tube in this embodiment is identical to that of FIG. 8, and its description will be omitted.

The operations of this embodiment different from those of the third embodiment are that when the high-pressure control valve 11 and the high-pressure second control valve 13 are opened at Step b (or the second half Step of compression), the high-pressure passage 18 is connected to the hot end 3*b* of the pulse tube 3 through the high-pressure control valve 11 (although to the pulse tube hot end 3*b* not through the high-pressure control valve 11 in the third embodiment), and that when the low-pressure control valve 11 and the low-pressure second control valve 14 are opened at Step e (or the second half Step of expansion), the low-pressure passage 19 is connected to the pulse tube hot end 3*b* through the low-pressure control valve 12 (although to the pulse tube hot end 3*b* not through the low-pressure control valve 12 in the third embodiment). Thus, there are achieved effects similar to those of the third embodiment.

[Sixth Embodiment]

Figure 13:
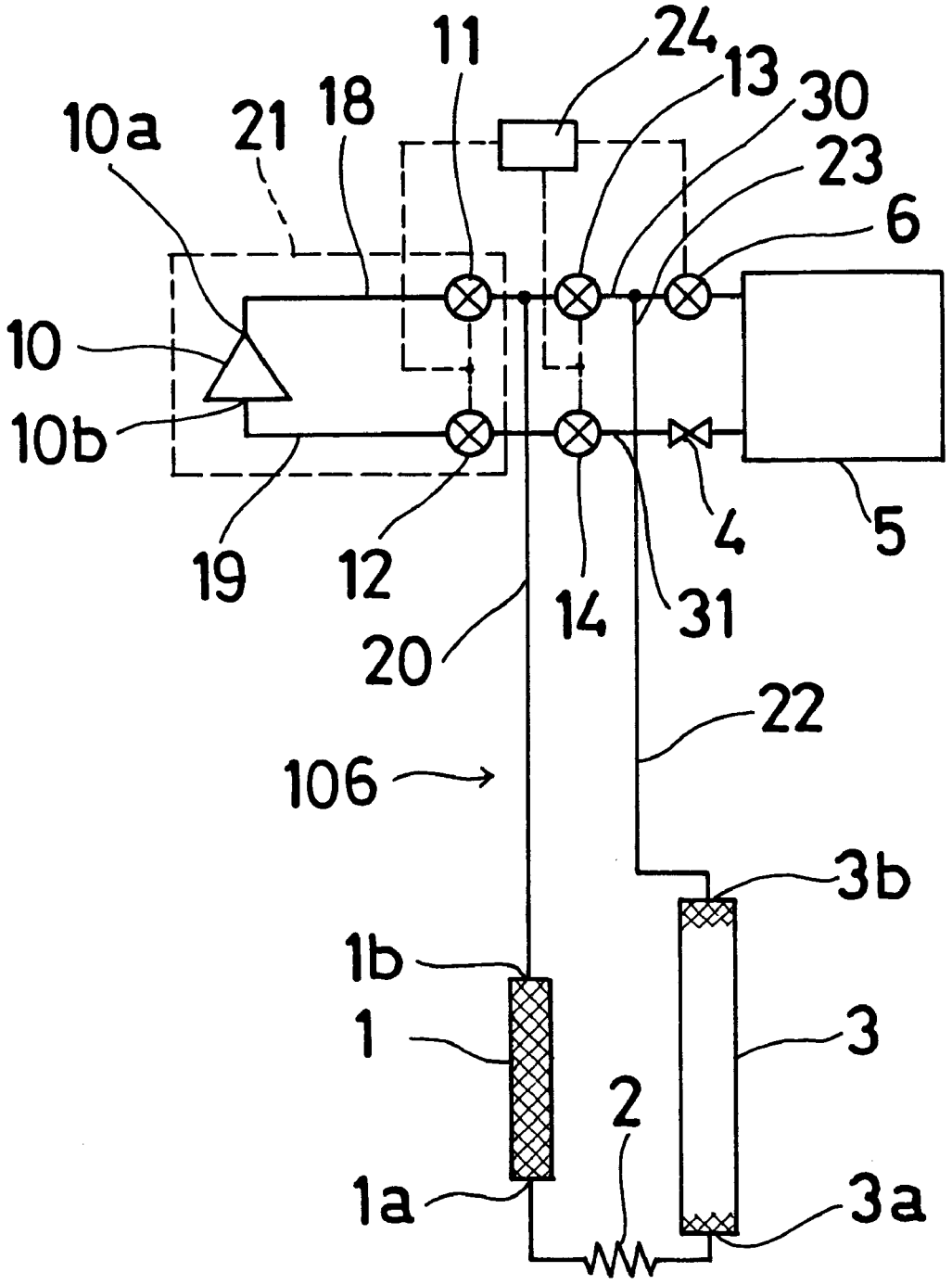
FIG. 13 is a schematic diagram showing the construction of a pulse tube refrigerator according to a sixth embodiment of the invention.

With reference to FIG. 13, here will be described the sixth embodiment of the invention, in which a construction of connecting the pressure fluctuation source and the pulse tube hot end in a mode different from that of the fourth embodiment is added to the aforementioned construction of the second embodiment. The sixth embodiment will be described stressing the added construction.

FIG. 13 is a schematic diagram showing a pulse tube refrigerator 106 of this embodiment. In FIG. 13, the connection passage 20 connecting the high-pressure control valve 11 and the low-pressure control valve 12 to the hot end 1*b* of the regenerator 1, and the passage 22 connecting the hot end 3*b* of the pulse tube 3 and the orifice 4 can be connected via the low-pressure connection passage 31 having the low-pressure second control valve 14. On the other hand, the connection passage 20 and the branch passage 23 branched from a mid-portion of the passage 22, can be connected via the high-pressure connection passage 30 having the high-pressure second control valve 13. As a result, when both the high-pressure control valve 11 and the high-pressure second control valve 13 are opened, the high-pressure passage 18 is connected to the hot end 3*b* of the pulse tube 3 through the high-pressure control valve 11, the connection passage 20, the high-pressure connection passage 30 having the high-pressure second control valve 13, the branch passage 23 and the passage 22. When both the low-pressure control valve 12 and the low-pressure second control valve 14 are opened, the low-pressure passage 19 is connected to the hot end 3*b* of the pulse tube 3 through the low-pressure control valve 12, the connection passage 20, the low-pressure connection passage 31 having the low-pressure second control valve 14, and the passage 22.

In the description of the pulse tube refrigerator 106, the description of other portions will be omitted because they are identical to those of the fourth embodiment.

In the pulse tube refrigerator 106 thus constructed, the actions (e.g., the controls of the individual control valves) are identical in principle to those of the foregoing fourth embodiment, i.e., the controls of the control valves shown in FIG. 10. The difference is that when the high-pressure control valve 11 and the high-pressure second control valve 13 are opened at Step b (or the second half Step of compression), the high-pressure passage 18 is connected to the hot end 3*b* of the pulse tube 3 through the high-pressure control valve 11 (although to the pulse tube hot end 3*b* not through the high-pressure control valve 11 in the fourth embodiment), and that when the low-pressure control valve 11 and the low-pressure second control valve 14 are opened at Step e (or the second half Step of expansion), the low-pressure passage 19 is connected to the pulse tube hot end 3*b* through the low-pressure control valve 12 (although to the pulse tube hot end 3*b* not through the low-pressure control valve 12 in the fourth embodiment). The remaining actions and effects are identical. Moreover, the equivalent PV diagram of the working fluid in the vicinity of the cold end of the pulse tube in this embodiment is identical to that of FIG. 8 as described in connection with the third embodiment, and its description will be omitted.

[Seventh Embodiment]

Figure 14:
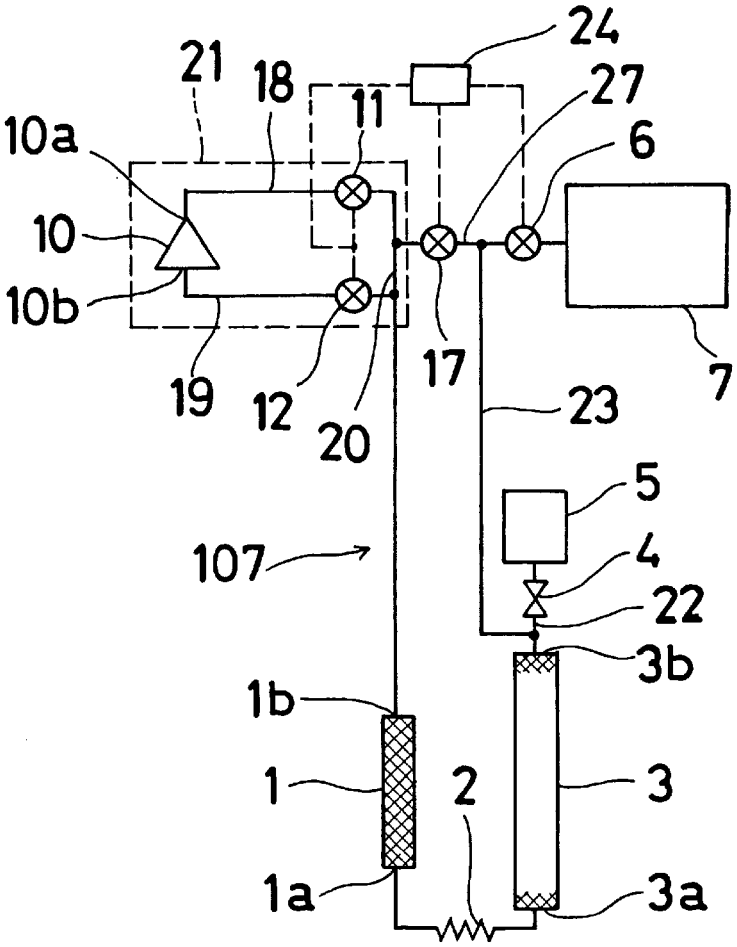
FIG. 14 is a schematic diagram showing the construction of a pulse tube refrigerator according to a seventh embodiment of the invention.
Figure 15:
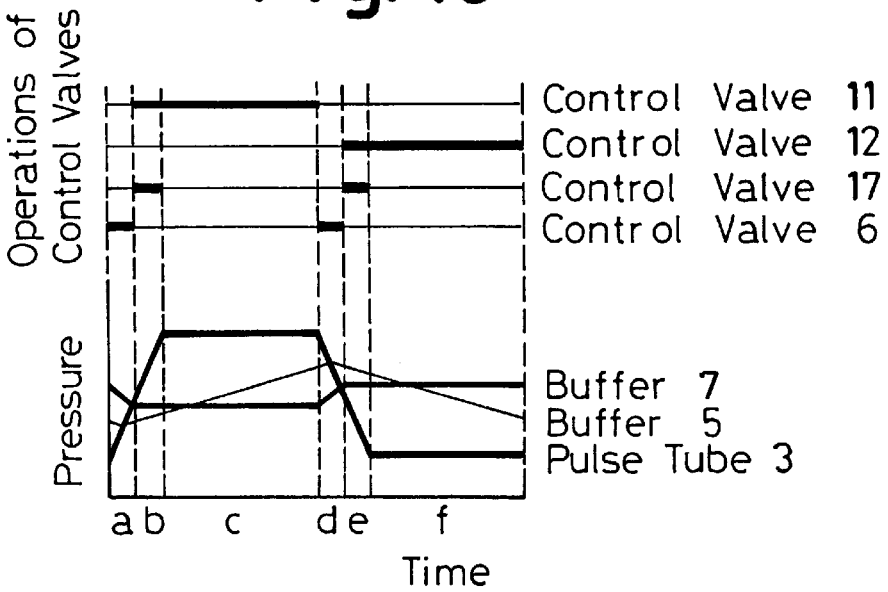
FIG. 15 is a graph illustrating the action states and pressure states of control valves of the pulse tube refrigerator in the seventh embodiment of the invention.

With reference to FIGS. 14 and 15, here will be described the seventh embodiment of the invention, in which a construction of connecting the pressure fluctuation source and the pulse tube hot end in a mode different from those of the third and fifth embodiments is added to the aforementioned construction of the first embodiment. The seventh embodiment will be described stressing the added construction.

FIG. 14 is a schematic diagram showing a pulse tube refrigerator 107 of this embodiment. FIG. 15 is a graph illustrating both the controlled states (of which the opened states are indicated by thick lines and the closed states are indicated by thin lines) of the high-pressure control valve 11, the low-pressure control valve 12, a common control valve 17 and the buffer side control valve 6 over time when the pulse tube refrigerator 107 of FIG. 14 is operating, and the pressure states of the working fluid in the buffer 5, the auxiliary buffer 7 and the pulse tube 3 over time. In FIG. 14, the connection passage 20 connecting the high-pressure control valve 11 and the low-pressure control valve 12 to the hot end 1*b* of the regenerator 1, and the branch passage 23 branched from the passage 22 connecting the hot end 3*b* of the pulse tube 3 and the orifice 4, are connected via a common passage 27 having the common control valve 17. As a result, when both the high-pressure control valve 11 and the common control valve 17 are opened, the high-pressure passage 18 is connected to the hot end 3*b* of the pulse tube 3 through the high-pressure control valve 11, the connection passage 20, the common passage 27 and the common control valve 17, the branch passage 23 and the passage 22. When both the low-pressure control valve 12 and the common control valve 17 are opened, the low-pressure passage 19 is connected to the hot end 3*b* of the pulse tube 3 through the low-pressure control valve 12, the connection passage 20, the common passage 27, the common control valve 17, the branch passage 23 and the passage 22. In other words, in the pulse tube refrigerator 107 of this embodiment, the two second passages (i.e., the high-pressure second passage 25 and the low-pressure second passage 26) and the two control valves (i.e., the high-pressure second control valve 13 and the low-pressure second control valve 14) of the pulse tube refrigerator 105 in the fifth embodiment are shared by one passage (i.e., the common passage 27) and one control valve (i.e., the common control valve 17). The high-pressure control valve 11, the low-pressure control valve 12, the common control valve 17 and the buffer side control valve 6 are individually controlled by the control unit 24.

The remaining construction is identical to that of the fifth embodiment, and its specific description will be omitted.

The operation of the pulse tube refrigerator 107 will be described with reference to FIG. 15. In this embodiment, the operation states of the pulse tube refrigerator 107 and the states of the internal working fluid accompanying the operations are also divided in terms of the time into the following six Steps a to f.

(1) Step a (First Half Step of Compression)

The state in which the high-pressure control valve 11, the low-pressure control valve 12 and the common control valve 17 are kept closed whereas the buffer side control valve 6 is exclusively kept open by closing the low-pressure control valve 12 and by opening the buffer side control valve 6. In this state, the working fluid in the buffer 5 flows into the pulse tube 3 through the orifice 4, and the working fluid in the auxiliary buffer 7 also flows into the pulse tube 3 through the buffer side control valve 6. In this case, the auxiliary buffer 7 and the pulse tube 3 are in communication with each other through the buffer side control valve 6 having a low pressure loss so that the pressure in the pulse tube 3 quickly rises from the minimum pressure to the pressure of the auxiliary buffer 7.

(2) Step b (Second Half Step of Compression)

The state in which the high-pressure control valve 11 and the common control valve 17 are opened whereas the buffer side control valve 6 is closed when the pressure in the pulse tube 3 rises from the minimum pressure to the auxiliary buffer pressure. In this state, the high-pressure passage 18 and the pulse tube 3 come into communication, but the communication between the pulse tube 3 and the auxiliary buffer 7 is interrupted by closing the buffer side control valve 6, so that the pressure in the pulse tube 3 rises from the auxiliary buffer pressure to the maximum pressure. At this time, the communication between the high-pressure passage 18 and the pulse tube 3 is via two passages: the passage from the high-pressure passage 18 to the pulse tube cold end 3*a* through the high-pressure control valve 11, the connection passage 20, the regenerator 1 and the cold head 2; and the passage from the high-pressure passage 18 to the pulse tube hot end 3*b* through the high-pressure control valve 11, the connection passage 20, the common passage 27, the common control valve 17, and the branch passage 23. Thus, the pulse tube 3 is exposed to the pressure at both the cold end 3*a* and the hot end 3*b*, thereby to suppress displacement of the working fluid in the vicinity of the pulse tube cold end 3*a*.

(3) Step c (Transfer Step to High Pressure)

The Step in which the high-pressure control valve 11 is kept open by closing the common control valve 17. In this state, the working fluid in the pulse tube 3 continuously flows out to the buffer 5 through the orifice 4, and the working fluid from the compressor 10 flows into the regenerator 1 via the high-pressure control valve 11, and into the pulse tube 3 while being cooled in the regenerator 1.

(4) Step d (First Half Step of Expansion)

The state in which the high-pressure and low-pressure control valves 11 and 12 and the common control valve 17 are kept closed whereas the buffer side control valve 6 is kept open by closing the high-pressure control valve 11 and by opening the buffer side control valve 6. In this state, the working fluid in the pulse tube 3 flows into the buffer 5 through the orifice 4 and further into the auxiliary buffer 7 through the buffer side control valve 6. In this case, the pulse tube 3 and the auxiliary buffer 7 are in communication through the buffer side control valve 6 having a low pressure loss, so that the pressure in the pulse tube 3 quickly drops from the maximum pressure to the pressure of the auxiliary buffer 7. As a result of this pressure drop, the working fluid in the pulse tube 3 adiabatically expands to lower its temperature.

(5) Step e (Second Half Step of Expansion)

The Step in which the low-pressure control valve 12 and the common control valve 17 are opened whereas the buffer side control valve 6 is closed when the pressure in the pulse tube 3 falls from the maximum pressure to the auxiliary buffer pressure. In this state, the low-pressure passage 19 and the pulse tube 3 come into communication, and the communication between the pulse tube 3 and the auxiliary buffer 7 is interrupted by closing the buffer side control valve 6, so that the pressure in the pulse tube 3 drops from the auxiliary buffer pressure to the minimum pressure. As a result, the working fluid in the pulse tube 3 further adiabatically expands to lower the temperature. At this time, the communication between the low-pressure passage 19 and the pulse tube 3 is by two passages: the passage from the low-pressure passage 19 to the pulse tube cold end 3*a* through the low-pressure control valve 12, the connection passage 20, the regenerator 1 and the cold head 2; and the passage from the low-pressure passage 19 to the pulse tube hot end 3*b* through low-pressure control valve 12, the connection passage 20, the common passage 27, the common control valve 17 and the branch passage 23. Thus, the pressure in the pulse tube 3 is released at both the cold end 3*a* and the hot end 3*b*, thereby to suppress displacement of the working fluid in the vicinity of the pulse tube cold end 3*a*.

(6) Step f (Low-pressure Transfer Step)

The state in which the low-pressure control valve 12 is kept open by closing the common control valve 17. In this state, the working fluid in the buffer 5 continuously flows into the pulse tube 3 through the orifice 4, and the cold working fluid in the pulse tube 3 cools the cold head 2 and the regenerator 1 and flows out from the low-pressure control valve 12 to the compressor 10.

The foregoing Steps a to f comprise one cycle and are repeated to establish such a state change in the working fluid as is illustrated in the equivalent PV diagram of FIG. 8, to establish an extremely low temperature in the cold head 2.

This embodiment can achieve effects similar to those of the third embodiment. In addition, the number of control valves can be made smaller than those of the third and fifth embodiments because the connection passage 20 connecting the high-pressure control valve 11 and the low-pressure control valve 12 to the hot end 1*b* of the regenerator 1, and the branch passage 23 branched from the passage 22 connecting the hot end 3*b* of the pulse tube 3 and the orifice 4, are connected via the common passage 27 having the common control valve 17. Thus, this embodiment contributes to a reduction in the production cost and a convenience for the valve controls.

[Eighth Embodiment]

Figure 16:
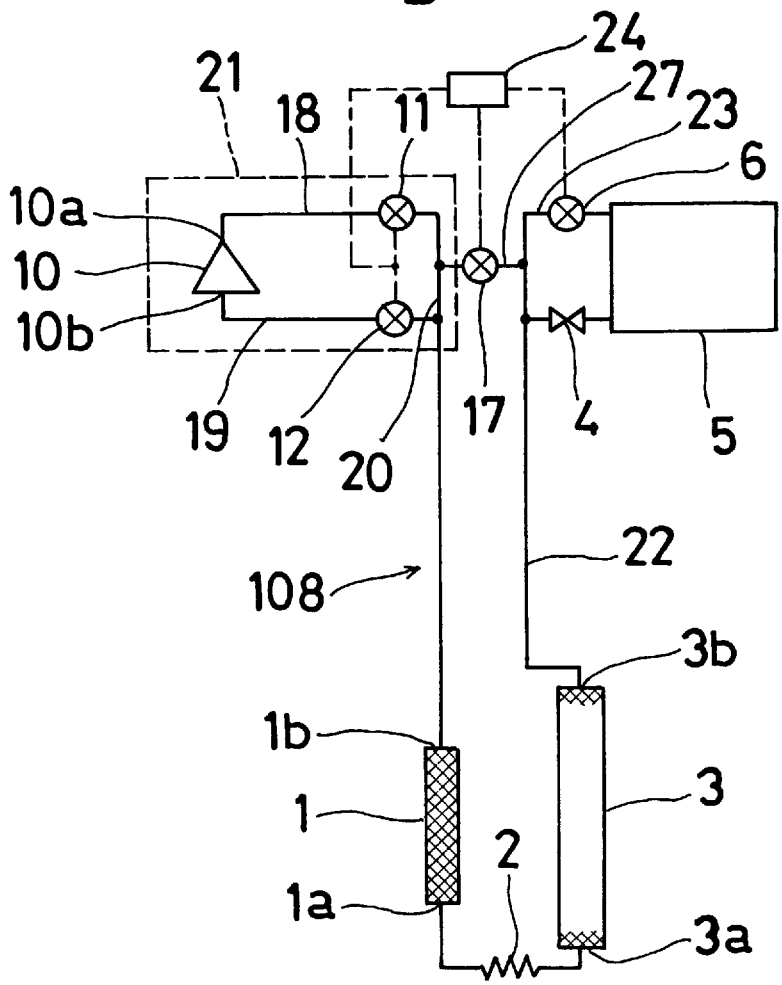
FIG. 16 is a schematic diagram showing the construction of a pulse tube refrigerator according to an eighth embodiment of the invention.
Figure 17:
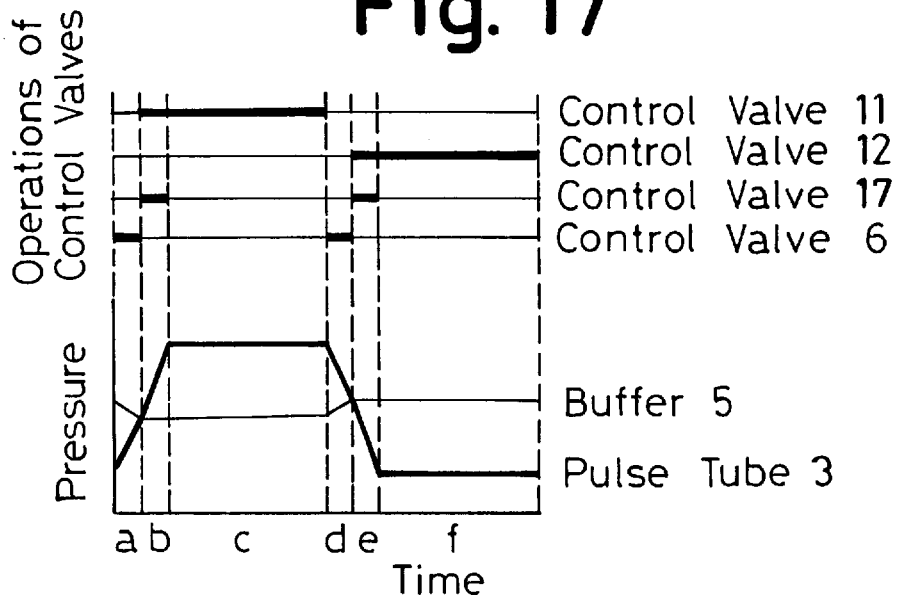
FIG. 17 is a graph illustrating the action states and pressure states of control valves of the pulse tube refrigerator in the eighth embodiment of the invention.

With reference to FIGS. 16 and 17, here will be described the seventh embodiment of the invention, in which a construction of connecting the pressure fluctuation source and the pulse tube hot end in a mode different from those of the fourth and sixth embodiments is added to the aforementioned construction of the second embodiment. The seventh embodiment will be described stressing the added construction.

FIG. 16 is a schematic diagram showing a pulse tube refrigerator 108 of this embodiment. FIG. 17 is a graph illustrating the controlled states (of which the opened states are indicated by thick lines and the closed states are indicated by thin lines) of the high-pressure control valve 11, the low-pressure control valve 12, the common control valve 17 and the buffer side control valve 6 over time when the pulse tube refrigerator 108 of FIG. 16 is operating, and the pressure states of the working fluid in the buffer 5, the auxiliary buffer 7 and the pulse tube 3 over time. In FIG. 16, the connection passage 20 connecting the high-pressure control valve 11 and the low-pressure control valve 12 to the hot end 1*b* of the regenerator 1, and the branch passage 23 branched from the passage 22 connecting the hot end 3*b* of the pulse tube 3 and the orifice 4, can be connected via the common passage 27 having the common control valve 17. As a result, when both the high-pressure control valve 11 and the common control valve 17 are opened, the high-pressure passage 18 is connected to the hot end 3*b* of the pulse tube 3 through the high-pressure control valve 11, the connection passage 20, the common passage 27, the common control valve 17, the branch passage 23 and the passage 22. When both the low-pressure control valve 12 and the common control valve 17 are opened, the low-pressure passage 19 is connected to the hot end 3*b* of the pulse tube 3 through the low-pressure control valve 12, the connection passage 20, the common passage 27, the common control valve 17, the branch passage 23 and the passage 22. In other words, in the pulse tube refrigerator 108 of this embodiment, the two second passages (i.e., the high-pressure second passage 25 and the low-pressure second passage 26) and the two control valves (i.e., the high-pressure second control valve 13 and the low-pressure second control valve 14) of the pulse tube refrigerator 106 in the sixth embodiment are shared by one passage (i.e., the common passage 27) and one control valve (i.e., the common control valve 17). The high-pressure control valve 11, the low-pressure control valve 12, the common control valve 17 and the buffer side control valve 6 are individually controlled by the control unit 24.

The operation of the pulse tube refrigerator 108 thus constructed will be described for the individual Steps a to f with reference to FIG. 16.

(1) Step a (First Half Step of Compression)

The state in which the high-pressure control valve 11, the low-pressure control valve 12, and the common control valve 17 are kept closed whereas the buffer side control valve 6 is exclusively kept open by closing the low-pressure control valve 12 and by opening the buffer side control valve 6. In this state, the working fluid in the buffer 5 flows from the passage 22 into the pulse tube 3 through the orifice 4 and further from the branch passage 23 into the pulse tube 3 through the buffer side control valve 6. In this case, the buffer 5 and the pulse tube 3 are in communication with each other through the buffer side control valve 6 having a low pressure loss so that the pressure in the pulse tube 3 quickly rises from the minimum pressure to the pressure of the buffer 5.

(2) Step b (Second Half Step of Compression)

The state in which the high-pressure control valve 11 and the common control valve 17 are opened whereas the buffer side control valve 6 is closed when the pressure in the pulse tube 3 rises from the minimum pressure to the auxiliary buffer pressure. In this state, the high-pressure passage 18 and the pulse tube 3 come into communication, but the communication via the branch passage 23 between the pulse tube 3 and the buffer 5 is interrupted by closing the buffer side control valve 6, so that the pressure in the pulse tube 3 rises from the auxiliary buffer pressure to the maximum pressure. At this time, the communication between the high-pressure passage 18 and the pulse tube 3 is by two passages: the passage from the high-pressure passage 18 to the pulse tube cold end 3*a* through the high-pressure control valve 11, the connection passage 20, the regenerator 1 and the cold head 2; and the passage from the high-pressure passage 18 to the pulse tube hot end 3*b* through the high-pressure control valve 11, the connection passage 20, the common passage 27, the common control valve 17, the branch passage 23 and the passage 22. Thus, the pulse tube 3 is exposed to the pressure from both the cold end 3*a* and the hot end 3*b*, thereby to suppress displacement of the working fluid in the vicinity of the pulse tube cold end 3*a*.

(3) Step c (Transfer Step to High Pressure)

The Step in which the high-pressure control valve 11 is kept open by closing the common control valve 17. In this state, the working fluid in the pulse tube 3 continuously flows out to the buffer 5 through the orifice 4, and the working fluid from the compressor 10 flows into the regenerator 1 through the high-pressure control valve 11, and into the pulse tube 3 while being cooled in the regenerator 1.

(4) Step d (First Half Step of Expansion)

The state in which the high-pressure and low-pressure control valves 11 and 12 and the common control valve 17 are kept closed whereas the buffer side control valve 6 is kept open by closing the high-pressure control valve 11 and by opening the buffer side control valve 6. In this state, the working fluid in the pulse tube 3 flows from the passage 22 into the buffer 5 through the orifice 4 and further from the branch passage 23 into the buffer 5 through the buffer side control valve 6. In this case, the pulse tube 3 and the buffer are in communication through the buffer side control valve 6 having a low pressure loss so that the pressure in the pulse tube 3 quickly drops from the maximum pressure to the pressure of the buffer 5. As a result of this pressure drop, the working fluid in the pulse tube 3 adiabatically expands to lower its temperature.

(5) Step e (Second Half Step of Expansion)

The Step in which the low-pressure control valve 12 and the common control valve 17 are opened whereas the buffer side control valve 6 is closed when the pressure in the pulse tube 3 falls from the maximum pressure to the buffer pressure. In this state, the low-pressure passage 19 and the pulse tube 3 come into communication, and the communication through the branch passage 23 between the pulse tube 3 and the buffer 5 is interrupted, so that the pressure in the pulse tube 3 drops from the buffer pressure to the minimum pressure. As a result, the working fluid in the pulse tube 3 further adiabatically expands to lower the temperature. At this time, the communication between the low-pressure passage 19 and the pulse tube 3 is made by two passages: the passage from the low-pressure passage 19 to the pulse tube cold end 3*a* through the low-pressure control valve 12, the connection passage 20, the regenerator 1 and the cold head 2; and the passage from the low-pressure passage 19 to the pulse tube hot end 3*b* through low-pressure control valve 12, the connection passage 20, the common passage 27, the common control valve 17, the branch passage 23 and the passage 22. Thus, the pulse tube 3 is released from pressure at both the cold end 3*a* and the hot end 3*b*, thereby to suppress displacement of the working fluid in the vicinity of the pulse tube cold end 3*a*.

(6) Step f (Low-pressure Transfer Step)

The state in which the low-pressure control valve 12 is kept open by closing the common control valve 17. In this state, the working fluid in the buffer 5 continuously flows into the pulse tube 3 through the orifice 4, and the cold working fluid in the pulse tube 3 cools the cold head 2 and the regenerator 1 and flows out from the low-pressure control valve 12 to the compressor 10.

The foregoing Steps a to f comprise one cycle and are repeated to establish an extremely low temperature in the cold head 2.

In this embodiment, effects similar to those of the fourth embodiment can be achieved, and the number of control valves can be made smaller than those of the fourth and sixth embodiments so that this embodiment contributes to a reduction in the production cost and convenience for the valve controls.

[Ninth Embodiment]

Figure 18:
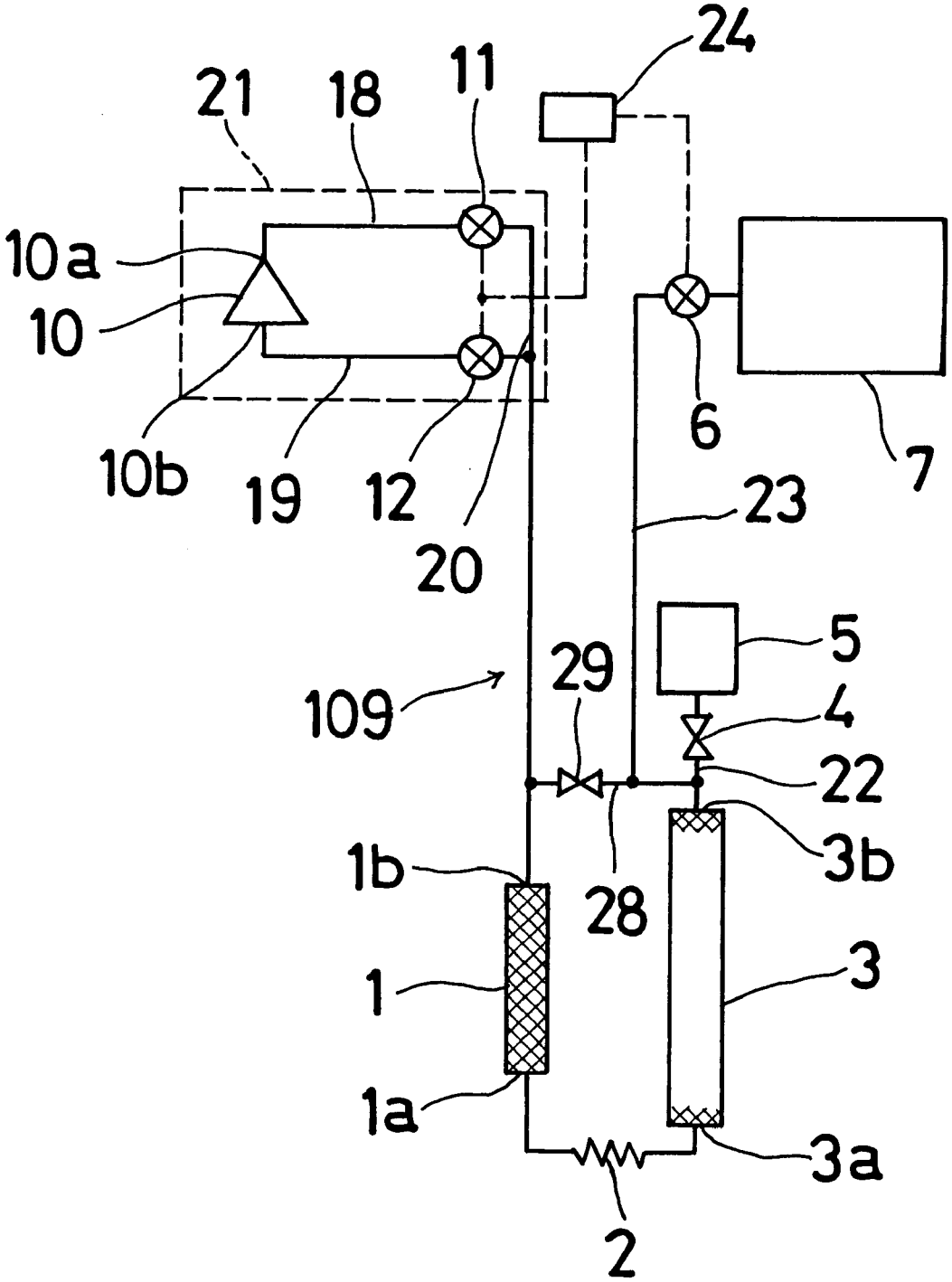
FIG. 18 is a schematic diagram showing the construction of a pulse tube refrigerator according to a ninth embodiment of the invention.

The ninth embodiment of the invention will be described with reference to FIG. 18. A pulse tube refrigerator 109, as shown in FIG. 18, is a double inlet type pulse tube refrigerator employing the construction of the pulse tube refrigerator 101 described in connection with the first embodiment as the prototype. As shown in FIG. 18, the connection passage 20 connecting the high-pressure control valve 11 and the low-pressure control valve 12 to the hot end 1*b* of the regenerator 1, and the branch passage 23 branched from the passage 22 connecting the hot end 3*b* of the pulse tube 3 and the orifice 4, are connected via a double inlet passage 28 having an orifice 29 in its mid-portion. The remaining construction is identical to that of the first embodiment, and its description will be omitted.

The actions of the double inlet type pulse tube refrigerator 109 thus constructed will be described. The control actions of the high-pressure valve 11, the low-pressure control valve 12 and the buffer side control valve 6 are identical to those of FIG. 2, as has been described in connection with the first embodiment, and will be described with reference to FIG. 2.

(1) Step a (First Half Step of Compression)

The state in which the high-pressure and low-pressure control valves 11 and 12 are kept closed whereas the buffer side control valve 6 is kept open by closing the low-pressure control valve 12 and by opening the buffer side control valve 6. In this state, the working fluid in the buffer 5 flows into the pulse tube 3 through the orifice 4, and the working fluid in the auxiliary buffer 7 also flows into the pulse tube 3 through the buffer side control valve 6. In this case, the auxiliary buffer 7 and the pulse tube 3 are in communication with each other through the buffer side control valve 6 having a low pressure loss so that the pressure in the pulse tube 3 quickly rises from the minimum pressure to the pressure of the auxiliary buffer 7.

(2) Step b (Second Half Step of Compression)

The state in which the high-pressure control valve 11 is opened whereas the buffer side control valve 6 is closed when the pressure in the pulse tube 3 rises from the minimum pressure to the auxiliary buffer pressure. In this state, the high-pressure passage 18 and the pulse tube 3 come into communication, but the communication between the pulse tube 3 and the auxiliary buffer 7 is interrupted by closing the buffer side control valve 6, so that the pressure in the pulse tube 3 rises from the auxiliary buffer pressure to the maximum pressure. At this time, the communication between the high-pressure passage 18 and the pulse tube 3 is by two passages: the passage from the high-pressure passage 18 to the pulse tube cold end 3*a* through the high-pressure control valve 11, the connection passage 20, the regenerator 1 and the cold head 2; and the passage from the high-pressure passage 18 to the pulse tube hot end 3*b* through the high-pressure control valve 11, the connection passage 20, the double inlet passage 28, the orifice 29, the branch passage 23 and the passage 22. Thus, the pulse tube 3 is exposed to the pressure from both the cold end 3*a* and the hot end 3*b*, thereby to suppress displacement of the working fluid in the vicinity of the pulse tube cold end 3*a*.

(3) Step c (Transfer Step to High Pressure)

The Step in which the high-pressure control valve 11 is kept open. In this state, the working fluid in the pulse tube 3 continuously flows out to the buffer 5 through the orifice 4, and the working fluid from the compressor 10 flows into the regenerator 1 through the high-pressure control valve 11, and into the pulse tube 3 while being cooled in the regenerator 1.

(4) Step d (First Half Step of Expansion)

The state in which the high-pressure and low-pressure control valves 11 and 12 are kept closed whereas the buffer side control valve is kept open by closing the high-pressure control valve 11 and by opening the buffer side control valve 6. In this state, the working fluid in the pulse tube 3 flows into the buffer 5 through the orifice 4 and further into the auxiliary buffer 7 through the buffer side control valve 6. In this case, the pulse tube 3 and the auxiliary buffer 7 are in communication through the buffer side control valve 6 having a low pressure loss so that the pressure in the pulse tube 3 quickly drops from the maximum pressure to the pressure of the auxiliary buffer 7. As a result of this pressure drop, the working fluid in the pulse tube 3 adiabatically expands to lower its temperature.

(5) Step e (Second Half Step of Expansion)

The Step in which the low-pressure control valve 12 is opened whereas the buffer side control valve 6 is closed when the pressure in the pulse tube 3 falls from the maximum pressure to the buffer pressure. In this state, the low-pressure passage 19 and the pulse tube 3 come into communication, and the communication between the pulse tube 3 and the auxiliary buffer 7 is interrupted by closing the buffer side control valve 6, so that the pressure in the pulse tube 3 drops from the auxiliary buffer pressure to the minimum pressure. As a result, the working fluid in the pulse tube 3 further adiabatically expands to lower its temperature. At this time, the communication between the low-pressure passage 19 and the pulse tube 3 is made by two passages: the passage from the low-pressure passage 19 to the pulse tube cold end 3*a* through the low-pressure control valve 12, the connection passage 20, the regenerator 1 and the cold head 2; and the passage from the low-pressure passage 19 to the pulse tube hot end 3*b* through the low-pressure control valve 12, the connection passage 20, the double inlet passage 28, the orifice 29, the branch passage 23 and the passage 22. Thus, the pulse tube 3 is exposed to the pressure at both the cold end 3*a* and the hot end 3*b*, thereby to suppress displacement of the working fluid in the vicinity of the pulse tube cold end 3*a*.

(6) Step f (Low-pressure Transfer Step)

The state in which the low-pressure control valve 12 is kept open. In this state, the working fluid in the buffer 5 continuously flows into the pulse tube 3 through the orifice 4, and the cold working fluid in the pulse tube 3 cools the cold head 2 and the regenerator 1 and flows out from the low-pressure control valve 12 to the compressor 10.

The foregoing Steps a to f comprise one cycle and are repeated to establish such a state change in the working fluid as is illustrated in the equivalent PV diagram of FIG. 3, to establish an extremely low temperature in the cold head 2.

This embodiment is constructed to include the double inlet passage 28 for connecting the connection passage 20 to the hot end 3*b* of the pulse tube 3 through the orifice 29. As a result, the pulse tube can be efficiently operated without controlling the orifice 29, to make the valve controls simpler.

[Tenth Embodiment]

Figure 19:
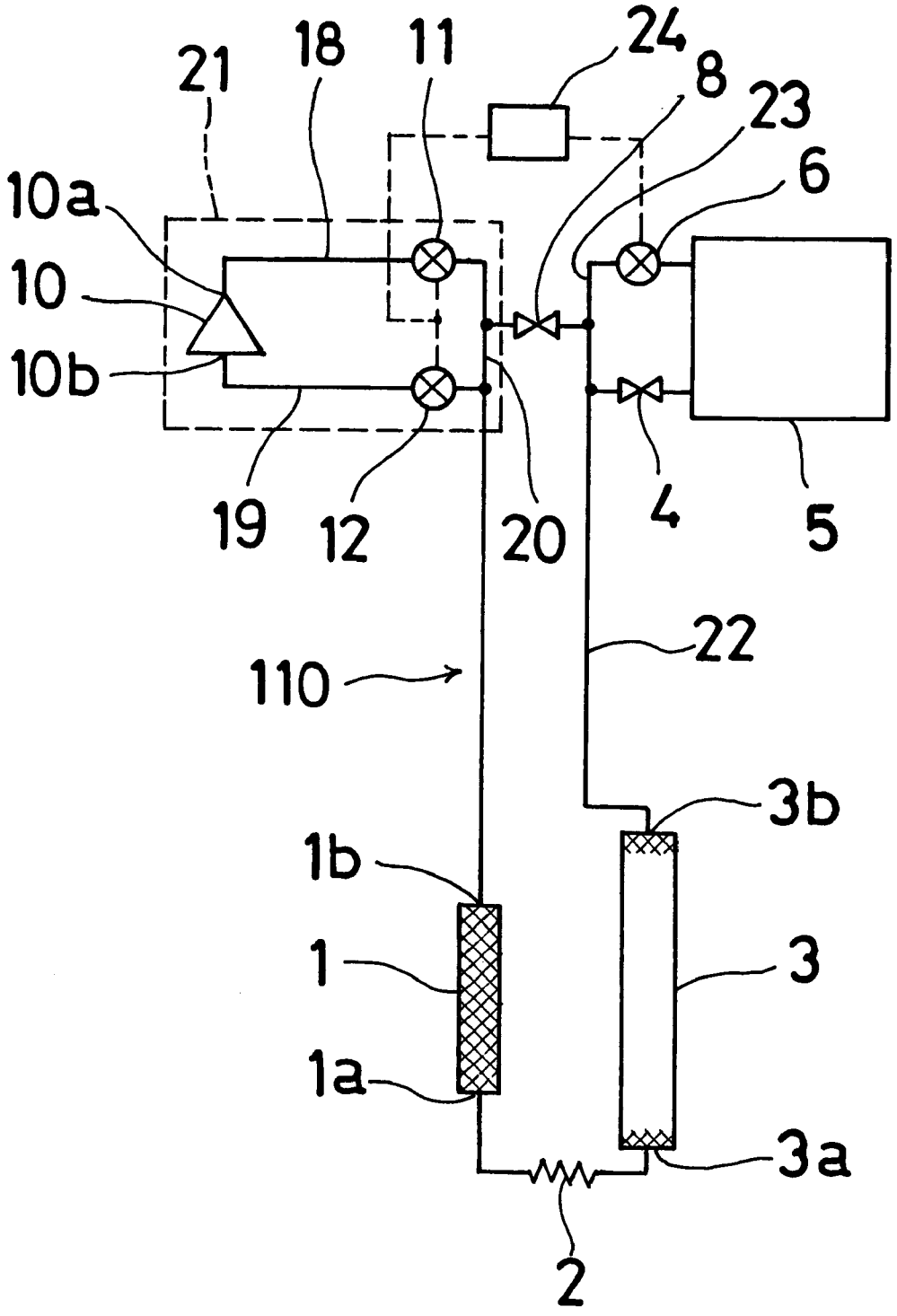
FIG. 19 is a schematic diagram showing the construction of a pulse tube refrigerator according to a tenth embodiment of the invention.
Figure 20:
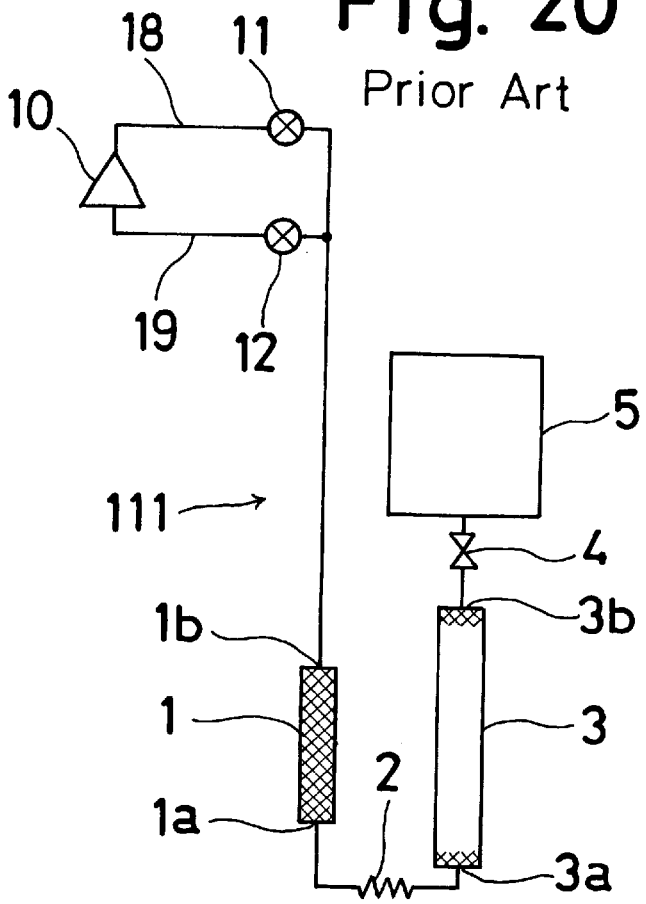
Fig. 20 Prior Art
FIG. 20 is a schematic diagram showing the construction of a conventional pulse tube refrigerator.
Figure 21:
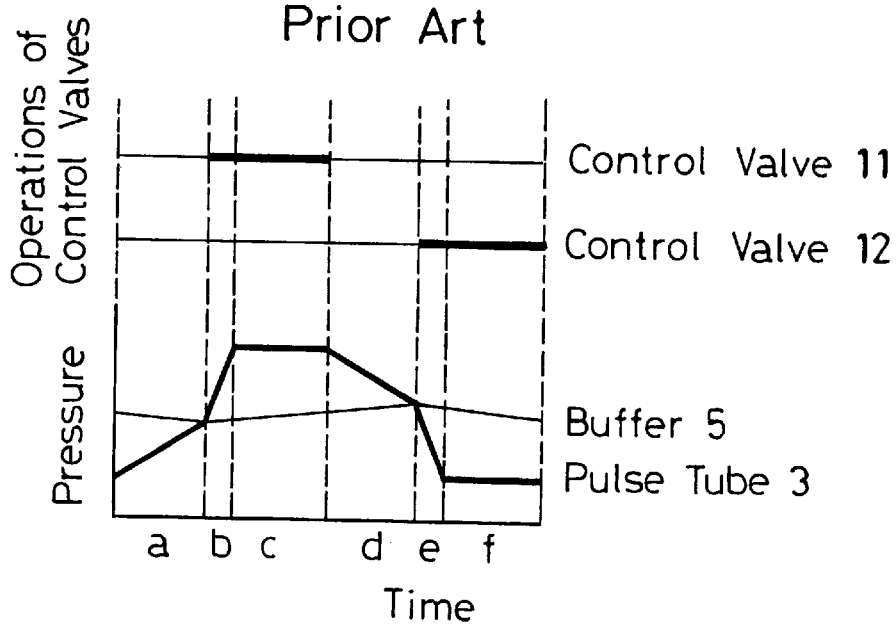
Fig. 21 Prior Art
FIG. 21 is a graph illustrating the action states and pressure states of control valves of the conventional pulse tube refrigerator.
Figure 22:
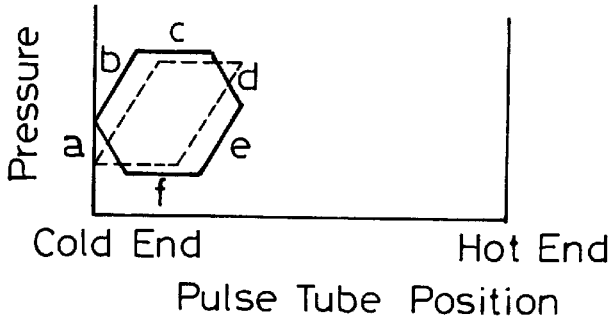
Fig. 22 Prior Art
FIG. 22 is an equivalent PV diagram of a working fluid in the vicinity of a pulse tube cold end in the conventional pulse tube refrigerator.
Figure 23:
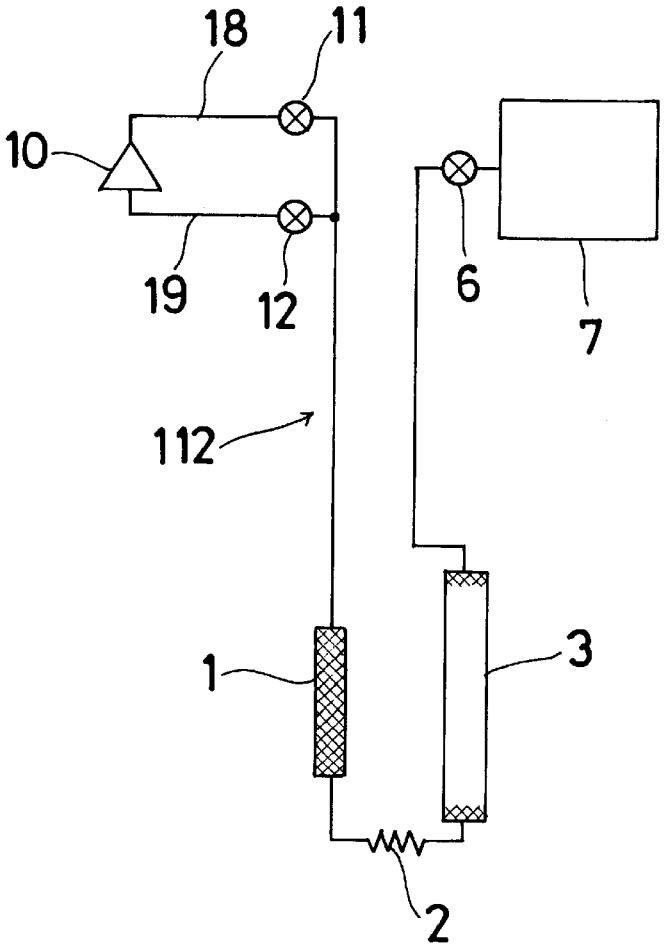
Fig. 23 Prior Art
FIG. 23 is a schematic diagram showing the construction of another conventional pulse tube refrigerator.
Figure 24:
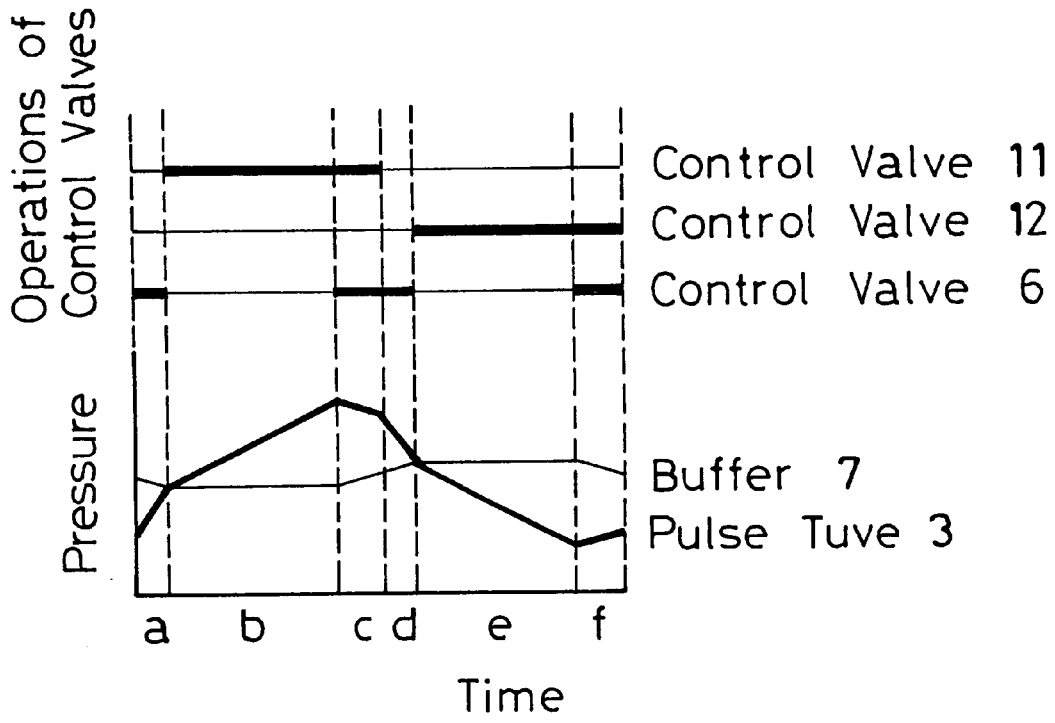
Fig. 24 Prior Art
FIG. 24 is a graph illustrating the action states and pressure states of control valves of the pulse tube refrigerator of FIG. 23.

The tenth embodiment of the invention will be described with reference to FIG. 19. A pulse tube refrigerator 110, as shown in FIG. 19, is a double inlet type pulse tube refrigerator employing the construction of the pulse tube refrigerator 102 described in connection with the second embodiment as the prototype. As shown in FIG. 19, the connection passage 20 connecting the high-pressure control valve 11 and the low-pressure control valve 12 to the hot end 1*b* of the regenerator 1, and the branch passage 23 branched from the passage 22 connecting the hot end 3*b* of the pulse tube 3 and the orifice 4, are connected via the double inlet passage 28 having the orifice 29 in its mid-portion. The remaining construction is identical to that of the second embodiment, and its description will be omitted.

The actions of the double inlet type pulse tube refrigerator 110 thus constructed will be described. The control actions of the high-pressure valve 11, the low-pressure control valve 12 and the buffer side control valve 6 are identical to those of FIG. 5, as has been described in connection with the second embodiment, and will be described with reference to FIG. 5.

(1) Step a (First Half Step of Compression)

The state in which the high-pressure and low-pressure control valve 11 and 12 are kept closed whereas the buffer side control valve 6 is kept open by closing the low-pressure control valve 12 and by opening the buffer side control valve 6. In this state, the working fluid in the buffer 5 flows from the passage 22 into the pulse tube 3 through the orifice 4 and further from the branch passage 23 into the pulse tube 3 through the buffer side control valve 6. In this case, the buffer 5 and the pulse tube 3 are in communication with each other through the buffer side control valve 6 having a low pressure loss so that the pressure in the pulse tube 3 quickly rises from the minimum pressure to the pressure of the buffer 5.

(2) Step b (Second Half Step of Compression)

The state in which the high-pressure control valve 11 is opened whereas the buffer side control valve 6 is closed when the pressure in the pulse tube 3 rises from the minimum pressure to the buffer pressure. In this state, the high-pressure passage 18 and the pulse tube 3 come into communication, but the communication via the branch passage 23 between the pulse tube 3 and the buffer 5 is interrupted by closing the buffer side control valve 6 so that the pressure in the pulse tube 3 rises from the auxiliary buffer pressure to the maximum pressure. At this time, the communication between the high-pressure passage 18 and the pulse tube 3 is by two passages: the passage from the high-pressure passage 18 to the pulse tube cold end 3*a* through the high-pressure control valve 11, the connection passage 20, the regenerator 1 and the cold head 2; and the passage from the high-pressure passage 18 to the pulse tube hot end 3*b* through the high-pressure control valve 11, the connection passage 20, the double inlet passage 28, the orifice 29, the branch passage 23 and the passage 22. Thus, the pulse tube 3 is exposed to pressure from both the cold end 3*a* and the hot end 3*b*, thereby to suppress displacement of the working fluid in the vicinity of the pulse tube cold end 3*a*.

(3) Step c (Transfer Step to High Pressure)

The Step in which the high-pressure control valve 11 is kept open. In this state, the working fluid in the pulse tube 3 continuously flows out to the buffer 5 through the orifice 4, and the working fluid from the compressor 10 flows into the regenerator 1 through the high-pressure control valve 11, and into the pulse tube 3 while being cooled in the regenerator 1.

(4) Step d (First Half Step of Expansion)

The state in which the high-pressure and low-pressure control valves 11 and 12 are kept closed whereas the buffer side control valve is kept open by closing the high-pressure control valve 11 and by opening the buffer side control valve 6. In this state, the working fluid in the pulse tube 3 flows from the passage 22 into the buffer 5 through the orifice 4 and further from the branch passage 23 into the buffer 5 through the buffer side control valve 6. In this case, the pulse tube 3 and the buffer 5 are in communication through the buffer side control valve 6 having a low pressure loss so that the pressure in the pulse tube 3 quickly drops from the maximum pressure to the pressure of the buffer 5. As a result of this pressure drop, the working fluid in the pulse tube 3 adiabatically expands to lower its temperature.

(5) Step e (Second Half Step of Expansion)

The Step in which the low-pressure control valve 12 is opened whereas the buffer side control valve 6 is closed when the pressure in the pulse tube 3 falls from the maximum pressure to the buffer pressure. In this state, the low-pressure passage 19 and the pulse tube 3 come into communication, and the communication through the branch passage 23 between the pulse tube 3 and the buffer 5 is interrupted by closing the buffer side control valve 6, so that the pressure in the pulse tube 3 drops from the buffer pressure to the minimum pressure. As a result, the working fluid in the pulse tube 3 further adiabatically expands to lower its temperature. At this time, the communication between the low-pressure passage 19 and the pulse tube 3 is by two passages: the passage from the low-pressure passage 19 to the pulse tube cold end 3*a* through the low-pressure control valve 12, the connection passage 20, the regenerator 1 and the cold head 2; and the passage from the low-pressure passage 19 to the pulse tube hot end 3*b* through the low-pressure control valve 12, the connection passage 20, the double inlet passage 28, the orifice 29, the branch passage 23 and the passage 22. Thus, the pulse tube 3 is exposed to pressure from both the cold end 3*a* and the hot end 3*b*, thereby to suppress displacement of the working fluid in the vicinity of the pulse tube cold end 3*a*.

(6) Step f (Low-pressure Transfer Step)

The state in which the low-pressure control valve 12 is kept open. In this state, the working fluid in the buffer 5 continuously flows into the pulse tube 3 through the orifice 4, and the cold working fluid in the pulse tube 3 cools the cold head 2 and the regenerator 1 and flows out from the low-pressure control valve 12 to the compressor 10.

The foregoing Steps a to f comprise one cycle and are repeated to establish an extremely low temperature in the cold head 2.

As has been described hereinbefore, the invention can provide a pulse tube refrigerator which has a remarkably improved efficiency, as compared with the prior art.

Although the invention has been described in connection with its preferred embodiments, it should not be limited thereto but can be applied to any type pulse tube refrigerator so long as it does not depart from the gist thereof.

What is claimed is:

1. A pulse tube refrigerator comprising:

a regenerator including a cold end and a hot end;

a cold head connected to the cold end of said regenerator;

a pulse tube having a cold end connected to said cold head, said pulse tube also having a hot end;

a pressure fluctuation source connected to the hot end of said regenerator;

a buffer connected to the hot end of said pulse tube through an orifice; and an auxiliary buffer connected to the hot end of said pulse tube through a buffer side control valve positioned between said auxiliary buffer and said hot end of said pulse tube.

2. A pulse tube refrigerator according to claim 1, wherein said pressure fluctuation source includes:

a compressor;

a high-pressure control valve connected to an outlet port of said compressor via a high-pressure passage;

a low-pressure control valve connected to an inlet port of said compressor via a low-pressure passage; and a connection passage connecting said high-pressure control valve and said low-pressure control valve to the hot end of said regenerator.

3. A pulse tube refrigerator according to claim 2, further comprising:

a high-pressure second passage connecting said high-pressure passage to the hot end of said pulse tube through a high-pressure second control valve; and a low-pressure second passage connecting said low-pressure passage to the hot end of said pulse tube through a low-pressure second control valve.

4. A pulse tube refrigerator according to claim 2, further comprising:

a high-pressure second connection passage connecting said connection passage to the hot end of said pulse tube through a high-pressure second control valve; and a low-pressure second connection passage connecting said connection passage to the hot end of said pulse tube through a low-pressure second control valve.

5. A pulse tube refrigerator according to claim 2, further comprising:

a common passage connecting said connection passage to the hot end of said pulse tube through a common control valve.

6. A pulse tube refrigerator according to claim 2, further comprising:

a double inlet passage connecting said connection passage to the hot end of said pulse tube through an orifice.

7. A pulse tube refrigerator comprising:

a regenerator including a cold end and a hot end;

a cold head connected to the cold end of said regenerator;

a pulse tube having a cold end connected to said cold head, said pulse tube also having a hot end;

a pressure fluctuation source connected to the hot end of said regenerator; and a buffer connected to the hot end of said pulse tube, further comprising an orifice and a buffer side control valve arranged in parallel between said buffer and said hot end of said pulse tube.

8. A pulse tube refrigerator according to claim 7, wherein said pressure fluctuation source includes:

a compressor;

a high-pressure control valve connected to the outlet port of said compressor via a high-pressure passage;

a low-pressure control valve connected to the inlet port of said compressor via a low-pressure passage; and a connection passage connecting said high-pressure control valve and said low-pressure control valve to the hot end of said regenerator.

9. A pulse tube refrigerator according to claim 8, further comprising:

a high-pressure second passage connecting said high-pressure passage to the hot end of said pulse tube through a high-pressure second control valve; and a low-pressure second passage connecting said low-pressure passage to the hot end of said pulse tube through a low-pressure second control valve.

10. A pulse tube refrigerator according to claim 8, further comprising:

a high-pressure second connection passage connecting said connection passage to the hot end of said pulse tube through a high-pressure second control valve; and a low-pressure second connection passage connecting said connection passage to the hot end of said pulse tube through a low-pressure second control valve.

11. A pulse tube refrigerator according to claim 8, further comprising:

a common passage connecting said connection passage to the hot end of said pulse tube through a common control valve.

12. A pulse tube refrigerator according to claim 8, further comprising:

a double inlet passage connecting said connection passage to the hot end of said pulse tube through an orifice.

* * * * *